US006502499B2

(12) United States Patent
Sannomiya et al.

(10) Patent No.: US 6,502,499 B2
(45) Date of Patent: Jan. 7, 2003

(54) HYDRAULIC RECOVERY SYSTEM FOR CONSTRUCTION MACHINE AND CONSTRUCTION MACHINE USING THE SAME

(75) Inventors: Naoto Sannomiya, Tsuchiura (JP); Sotaro Tanaka, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/963,056

(22) Filed: Sep. 26, 2001

(65) Prior Publication Data

US 2002/0108486 A1 Aug. 15, 2002

(30) Foreign Application Priority Data

Sep. 26, 2000 (JP) ..... 2000-291507

(51) Int. Cl.[7] ..... F15B 11/024
(52) U.S. Cl. ..... 91/436; 91/444
(58) Field of Search ..... 91/436, 444, 446, 91/448; 137/596.12, 596.13

(56) References Cited

U.S. PATENT DOCUMENTS

| | | | | | |
|---|---|---|---|---|---|
| 3,438,307 | A | * | 4/1969 | Ahlenius | 91/436 |
| 4,215,720 | A | * | 8/1980 | Becker | 137/596.13 |
| 4,345,736 | A | * | 8/1982 | Zeuner et al. | 137/596.12 |
| 4,391,571 | A | * | 7/1983 | Craggs | 91/436 X |
| 4,432,270 | A | * | 2/1984 | Kyster et al. | 91/436 X |
| 4,736,673 | A | * | 4/1988 | Harada et al. | 91/436 |
| 5,101,628 | A | * | 4/1992 | Yoshino | 91/436 X |
| 5,168,705 | A | * | 12/1992 | Hirata et al. | 137/596.13 |
| 5,218,897 | A | * | 6/1993 | Shirai et al. | 137/596.13 |
| 5,615,705 | A | | 4/1997 | Cho | |
| 5,791,226 | A | * | 8/1998 | Chung et al. | 91/436 X |
| 5,862,831 | A | | 1/1999 | Chung et al. | |

FOREIGN PATENT DOCUMENTS

| | | |
|---|---|---|
| EP | 0629781 | 12/1994 |
| JP | 3-117704 | 5/1991 |
| JP | 7-305379 | 11/1995 |
| JP | 07305379 | 11/1995 |
| JP | 08193601 | 7/1996 |

* cited by examiner

*Primary Examiner*—John E. Ryznic
(74) *Attorney, Agent, or Firm*—Mattingly, Stanger & Malur, P.C.

(57) ABSTRACT

A hydraulic recovery system for a construction machine comprises a recovery valve for supplying at least a part of a hydraulic fluid from a rod-side line, through which the hydraulic fluid is drained from a rod-side hydraulic chamber of an arm hydraulic cylinder, to a bottom-side line through a variable throttle, and a throttle valve for returning the remaining part of the hydraulic fluid, which is not recovered, from the rod-side line to a hydraulic reservoir through a variable throttle. Opening areas of those variable throttles are controlled depending on an arm flow rate supplied from hydraulic pumps to the arm hydraulic cylinder.

20 Claims, 13 Drawing Sheets

HYDRAULIC RECOVERY SYSTEM FOR CONSTRUCTION MACHINE AND CONSTRUCTION MACHINE USING THE SAME

BACKGROUND OF THE INVENTION

1. Field of the Invention

The present invention relates to a hydraulic recovery apparatus for use in a construction machine such as a hydraulic excavator, and a construction machine using the hydraulic recovery apparatus.

2. Description of the Related Art

For example, a hydraulic excavator usually comprises a lower travel structure; an upper swing structure rotatably mounted on the lower travel structure; a multi-articulated front mechanism rotatably coupled to the upper swing structure and including a boom, an arm and a bucket; and a plurality of actuators including a boom hydraulic cylinder, an arm hydraulic cylinder and a bucket hydraulic cylinder for driving the boom, the arm and the bucket, respectively.

For some of among the plurality of actuators, a higher actuator speed has recently been required, as operators have become skillful in operation of a hydraulic excavator. When performing an arm crowding operation, for example, the arm is preferably operated at a higher speed from the standpoint of work efficiency during a stroke until the bucket reaches the ground surface. In such a case, therefore, associated mechanisms are required to operate at higher speeds.

As a means for meeting that demand for speed-up, there is known a hydraulic recovery apparatus including a recovery circuit which returns a hydraulic fluid on the rod side of a hydraulic cylinder to the bottom side with a selector valve or the like for increasing the speed at which a cylinder rod is extended at the same pump delivery rate, thereby recovering energy (or keeping the same speed at a smaller pump delivery rate). Such a conventional hydraulic recovery apparatus is disclosed in, e.g., JP,A 3-117704.

The disclosed hydraulic recovery apparatus is equipped in a hydraulic drive system for a construction machine in which a plurality of actuators, such as a boom hydraulic cylinder, an arm hydraulic cylinder and a bucket hydraulic cylinder, are driven by a hydraulic fluid supplied from a hydraulic pump that is driven by a prime mover such as an engine. Then, the disclosed hydraulic recovery apparatus comprises a first line for supplying the hydraulic fluid to the bottom side of the arm hydraulic cylinder; a second line for draining the hydraulic fluid from the rod side of the arm hydraulic cylinder; and a hydraulic selector valve including a recovery line for supplying at least a part of the hydraulic fluid from the second line to the first line, and a drain line for returning the remaining part of the hydraulic fluid, which is not recovered, from the second line to a hydraulic reservoir through restricting means.

In that hydraulic recovery apparatus, during the arm crowding operation where the hydraulic selector valve is shifted to one side and the hydraulic fluid is supplied to a bottom side hydraulic chamber of the arm hydraulic cylinder, when the load imposed on the arm hydraulic cylinder is relatively small and the pressure in the bottom side hydraulic chamber is relatively low, most of the hydraulic fluid drained from the rod side of the arm hydraulic cylinder to the second line is introduced to the first line via the recovery line rather than to the drain line in which the restricting means is disposed, and is returned to the bottom side of the arm hydraulic cylinder (joined recovery state). As the load imposed on the arm hydraulic cylinder increases and the pressure in the bottom side hydraulic chamber rises, the amount of the hydraulic fluid introduced to the recovery line is reduced and a larger amount of the hydraulic fluid is introduced to the drain line in which the restricting means is disposed. Finally, the hydraulic fluid is all introduced to only the drain line and then drained to the hydraulic reservoir (end of recovery joining).

In addition, the relationship between the load of the arm hydraulic cylinder and the end of recovery joining can be optionally set by constructing the throttling means as a variable throttle driven with a pilot pressure.

SUMMARY OF THE INVENTION

The above-mentioned related art, however, has the following problems.

In the related-art hydraulic recovery apparatus, as described above, the recovery operation is basically performed by simple control, namely, just by switching over the start of recovery joining and the end of recovery joining depending on the load pressure of the arm hydraulic cylinder.

When the operating mode of a hydraulic excavator is changed, for example, from the arm-crowding sole operation to the arm-crowding and bucket-crowding combined operation, a part of the delivery rate from a hydraulic pump is introduced not to the side of the arm hydraulic cylinder, but to the side of the bucket hydraulic cylinder. Even in the case where the load pressure of the arm hydraulic cylinder is relatively low and the system is in the joined recovery state, therefore, the above situation may often result in that the hydraulic fluid cannot be supplied at a sufficient flow rate to the bottom side of the arm hydraulic cylinder in spite of a recovery flow rate being added, and the arm hydraulic cylinder cannot follow the arm crowding operation in a satisfactory manner. Such a deficiency of the supply flow rate causes the occurrence of bubbles (cavitation) in the bottom side hydraulic chamber of the arm hydraulic cylinder and hydraulic circuits connected to it, thus resulting in deterioration of operability and durability.

While the above description is made, by way of example, in connection with a deficiency of the supply flow rate caused upon a shift from the sole operation to the combined operation, the occurrence of a deficiency of the supply flow rate is not limited to such a case. A similar situation also occurs, for example, when the revolution speed of a prime mover for driving the hydraulic pump is reduced, and a similar problem arises in that case as well.

Accordingly, it is an object of the present invention to provide a hydraulic recovery apparatus for a construction machine and a construction machine using the hydraulic recovery apparatus, which can prevent the occurrence of cavitation upon, e.g., a shift to the combined operation and a decrease in revolution speed of a prime mover, and which can improve operability and durability.

(1) To achieve the above object, a hydraulic recovery apparatus for a construction machine, according to the present invention, is provided in a hydraulic drive system for driving a plurality of actuators by a hydraulic fluid supplied from at least one hydraulic pump in the construction machine, and comprises a first line for supplying the hydraulic fluid to the bottom side of at least one particular hydraulic cylinder among the plurality of actuators; a second line for draining the hydraulic fluid from the rod side of the particular hydraulic cylinder; a recovery valve means for supplying at least a part of the hydraulic fluid from the second line to the first line; a second variable throttle provided in the recovery valve means and supplying at least the part of the hydraulic fluid from the second line to the first line at a desired opening; a throttle valve means for returning the remaining part of the hydraulic fluid, which is not recovered, from the second line to a hydraulic reservoir; a first variable throttle provided in the throttle valve means and returning the remaining part of the hydraulic fluid, which is not recovered, to the hydraulic reservoir at a desired opening; and a control means for controlling respective opening areas of the first variable throttle and the second variable throttle depending on an actuator flow rate supplied from the hydraulic pump to the particular hydraulic cylinder.

With the present invention, the second variable throttle is provided in the recovery valve means for supplying a part of the hydraulic fluid from the second line to the first line, and the first variable throttle is provided in the throttle valve means for returning the remaining part of the hydraulic fluid, which is not recovered, from the second line to the hydraulic reservoir. By properly controlling amounts by which the hydraulic fluid is throttled by the second throttle valve and the first throttle valve, therefore, a balance (distribution) between a recovery flow rate recovered from the rod side to the bottom side of the particular hydraulic cylinder and a drain (non-recovery) flow rate not recovered from the rod side to the bottom side of the particular hydraulic cylinder, but drained to the hydraulic reservoir, can be adjusted.

To that end, in the present invention, the control means controls the opening areas of the first variable throttle and the second variable throttle depending on the actuator flow rate supplied from the hydraulic pump to the particular hydraulic cylinder. More specifically, the flow rate of the hydraulic fluid introduced to an arm hydraulic cylinder (i.e., an actuator flow rate supplied to the arm hydraulic cylinder) is often abruptly reduced upon, e.g., a shift of the operating mode of a hydraulic excavator, in which the mode is shifted from the arm-crowding sole operation to the arm-crowding and bucket-crowding combined operation and a part of the delivery rate of the hydraulic pump is introduced to a bucket hydraulic cylinder, or a decrease in revolution speed of a prime mover. In response to such a situation, the opening area of the first variable throttle in the throttle valve means is reduced to decrease the non-recovery flow rate, and the opening area of the second variable throttle in the recovery valve means is increased to increase the recovery flow rate. As a result, the reduction of the actuator flow rate is compensated by increasing the recovery flow rate so that the hydraulic fluid can be continuously supplied at a sufficient flow rate to the bottom side of the arm hydraulic cylinder and the arm hydraulic cylinder can follow the arm crowding operation in a satisfactory manner. It is hence possible to prevent cavitation from occurring in the bottom side hydraulic chamber of the particular hydraulic cylinder (arm hydraulic cylinder in this case) and its peripheral hydraulic circuits due to a deficiency of the supply flow rate, and to improve operability and durability.

(2) In above (1), preferably, the control means comprises an actuator flow rate detecting means for detecting the actuator flow rate, and an opening area varying means for varying the respective opening areas of the first variable throttle and the second variable throttle depending on the detected actuator flow rate.

(3) In above (2), preferably, the actuator flow rate detecting means comprises a delivery rate detecting means for detecting a delivery rate of the hydraulic pump, and a distribution ratio deciding means for deciding a distribution ratio of the detected delivery rate to respective actuators.

(4) In above (3), preferably, the delivery rate detecting means comprises a revolution speed detecting means for detecting a revolution speed of a prime mover for driving the hydraulic pump.

With that feature, even when the revolution speed of the prime mover is changed upon, e.g., an increase in load of any actuator or a shift in setting revolution speed or operating mode of the prime mover, and the delivery rate of the hydraulic pump is changed, the actuator flow rate can be detected with high accuracy responsively. In such a case, therefore, it is also possible to surely prevent cavitation from occurring in the bottom side hydraulic chamber of the particular hydraulic cylinder and peripheral hydraulic circuits connected to it due to a deficiency of the supply flow rate, and to improve operability and durability.

(5) In above (4), preferably, the delivery rate detecting means comprises a plurality of input amount detecting means for detecting respective input amounts of a plurality of operating means for operating the plurality of actuators.

With that feature, even when pump delivery rate control (e.g., negative control, positive control, or load sensing control) is performed depending on the input amounts of the operating means, the actuator flow rate can be detected with high accuracy responsively. In such a case, therefore, it is also possible to surely prevent cavitation from occurring in the bottom side hydraulic chamber of the particular hydraulic cylinder and peripheral hydraulic circuits connected to it due to a deficiency of the supply flow rate, and to improve operability and durability.

(6) Also in above (3), preferably, the distribution ratio deciding means comprises an opening area ratio detecting means for detecting an opening area ratio between a plurality of control valves disposed between the hydraulic pump and the plurality of actuators, respectively, for controlling flows of the hydraulic fluid supplied to the corresponding actuators, and a modifying means for modifying the detected opening area ratio depending on operating states of the plurality of actuators.

(7) Also in above (2), preferably, the opening area varying means comprises first and second throttle flow rate deciding means for deciding respective throttle flow rates through the second variable throttle and the first variable throttle depending on the detected actuator flow rate, and first and second opening area deciding means for deciding respective opening areas of the second variable throttle and the first variable throttle depending on the decided throttle flow rates.

(8) In above (7), preferably, the first throttle flow rate deciding means decides the throttle flow rate through the second variable throttle in accordance with both an inlet setting flow rate at which the hydraulic fluid is introduced to the bottom side of the particular hydraulic cylinder, and the detected actuator flow rate.

(9) In above (8), preferably, the second throttle flow rate deciding means decides the throttle flow rate through the first variable throttle in accordance with the inlet setting flow rate, a volume ratio between a bottom-side hydraulic chamber and a rod-side hydraulic chamber of the particular hydraulic cylinder, and the decided throttle flow rate through the second variable throttle.

(10) Also in above (7), preferably, the first opening area deciding means decides the opening area of the second variable throttle in accordance with the decided throttle flow rate through the second variable throttle, a bottom setting pressure set to prevent the occurrence of cavitation in a bottom-side hydraulic chamber of the particular hydraulic cylinder, a volume ratio between the bottom-side hydraulic chamber and a rod-side hydraulic chamber of the particular hydraulic cylinder, and a holding pressure to be maintained in the particular hydraulic cylinder.

(11) In above (10), preferably, the second opening area deciding means decides the opening area of the first variable throttle in accordance with the decided throttle flow rate through the first variable throttle, the bottom setting pressure, the volume ratio, the holding pressure, and a reservoir pressure in the hydraulic reservoir.

(12) Further, to achieve the above object, a construction machine according to the present invention comprises a lower travel structure; an upper swing structure rotatably mounted on the lower travel structure; a multi-articulated front mechanism rotatably coupled to the upper swing structure and including a boom, an arm and a bucket; a plurality of actuators including a boom hydraulic cylinder, an arm hydraulic cylinder and a bucket hydraulic cylinder for driving the boom, the arm and the bucket, respectively; a first line for supplying a hydraulic fluid to the bottom side of at least one particular hydraulic cylinder among the plurality of actuators; a second line for draining the hydraulic fluid from the rod side of the particular hydraulic cylinder; a recovery valve means for supplying at least a part of the hydraulic fluid from the second line to the first line through a second variable throttle; a throttle valve means for returning the remaining part of the hydraulic fluid, which is not recovered, from the second line to a hydraulic reservoir through a first variable throttle; and a control means for controlling respective opening areas of the first variable throttle and the second variable throttle depending on an actuator flow rate supplied from the hydraulic pump to the particular hydraulic cylinder.

(13) In above (12), preferably, the control means comprises an actuator flow rate detecting means for detecting the actuator flow rate, and an opening area varying means for varying the respective opening areas of the first variable throttle and the second variable throttle depending on the detected actuator flow rate.

(14) In above (12) or (13), preferably, the recovery valve means is disposed, with respect to a particular control valve for controlling a flow of the hydraulic fluid supplied to the particular hydraulic cylinder from the hydraulic pump and to the particular hydraulic cylinder, at a position nearer to at least the particular hydraulic cylinder.

It is a general rule that, when recovering a part of the hydraulic fluid drained from a hydraulic cylinder, the recovery flow rate can be more easily increased as the recovery line pressure on the rod side of the hydraulic cylinder is higher and the recovery line pressure on the bottom side of the hydraulic cylinder is lower. On the other hand, when the hydraulic fluid is supplied to the hydraulic cylinder through a control valve for controlling a flow of the hydraulic fluid from the hydraulic pump, the hydraulic pump, the control valve and the hydraulic cylinder are interconnected in the order named. In that arrangement, if a recovery line is disposed remotely from the hydraulic cylinder, a pressure loss caused in an intermediate line becomes relatively large. Thus, the recovery line pressure on the bottom side is increased because it is positioned closer to the hydraulic pump, and the recovery line pressure on the rod side is reduced by an amount corresponding to the above-mentioned pressure loss. It is hence difficult to obtain a large recovery flow rate.

In view of such a difficulty, in this embodiment, the recovery valve means is disposed at a position nearer to at least the particular hydraulic cylinder of the particular control valve and the particular hydraulic cylinder. With that arrangement, the pressure loss in the recovery line can be reduced so that the pressure at a port of the recovery valve means communicating with the rod side of the particular hydraulic cylinder can be maintained relatively high and the pressure at a port of the recovery valve means communicating with the bottom side thereof can be maintained relatively low. Accordingly, a larger recovery flow rate can be more easily obtained.

(15) In above (14), preferably, the recovery valve means is disposed on the particular hydraulic cylinder.

(16) Also in above (12) or (13), preferably, the recovery valve means is disposed on the boom.

(17) Further in above (12) or (13), preferably, the recovery valve means and the throttle valve means are constructed as an integral unit and are disposed on the boom.

DESCRIPTION OF THE PREFERRED EMBODIMENTS

One embodiment of the present invention will be described below with reference to the drawings. This embodiment represents the case where the present invention is applied to a hydraulic excavator as one example of construction machines.

Figure 1:
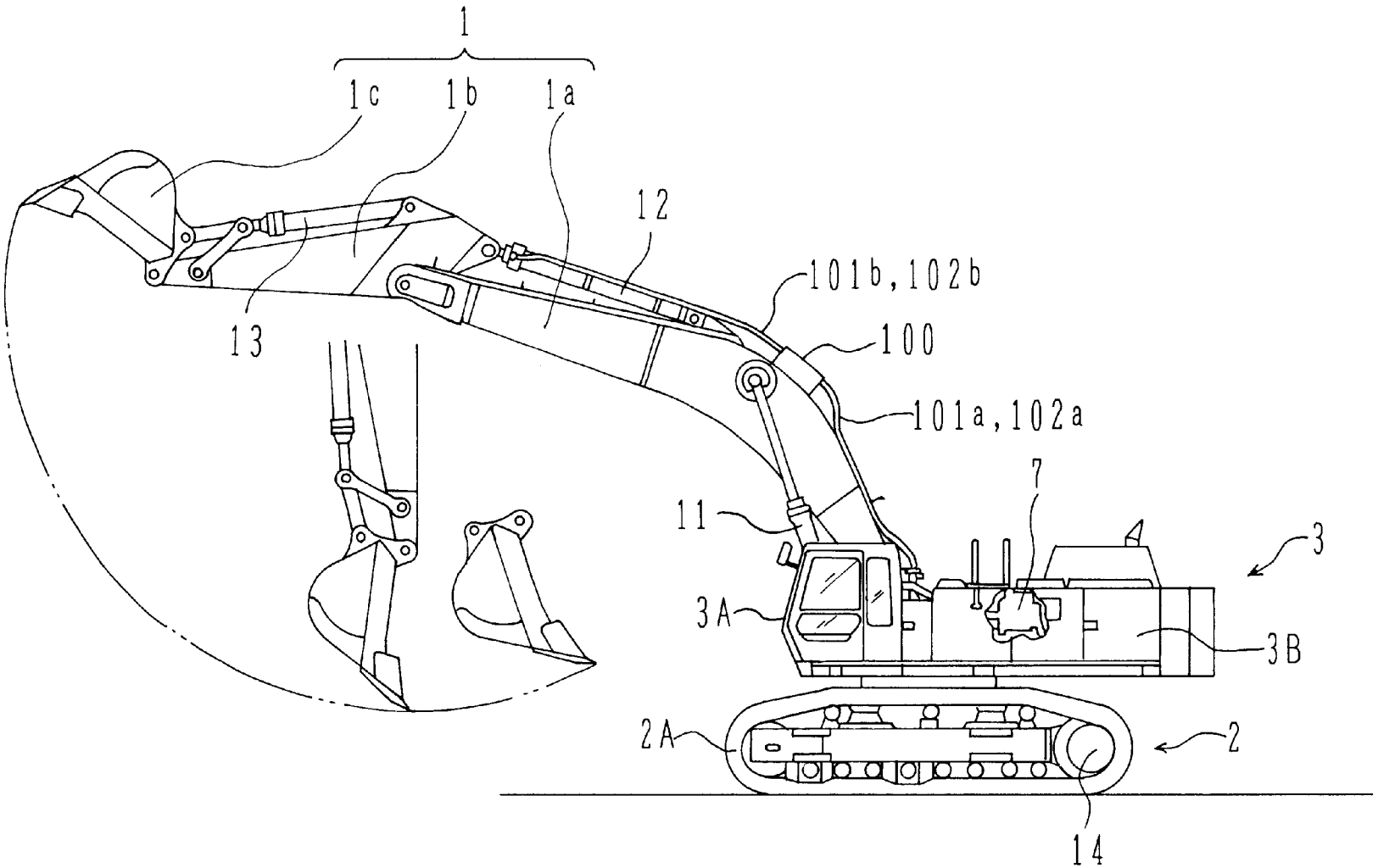
FIG. 1 is a side view showing an overall structure of a hydraulic excavator to which a hydraulic recovery system according to one embodiment of the present invention is applied.

FIG. 1 is a side view showing an overall structure of a hydraulic excavator to which a hydraulic recovery system of this embodiment is applied. Referring to FIG. 1, the hydraulic excavator is of the so-called backhoe type and comprises a boom 1*a,* an arm 1*b* and a bucket 1*c,* which constitute a multi-articulated front mechanism 1 and are each rotatable in the vertical direction. The hydraulic excavator further comprises a lower travel structure 2 and an upper swing structure 3.

The boom 1*a,* the arm 1*b* and the bucket 1*c* are interconnected in a vertically rotatable manner, and a base end of the boom 1*a* is supported by a front portion of the upper swing structure 3.

The lower travel structure 2 includes a crawler 2A on each of the left and right sides. The upper swing structure 3 includes a cab 3A in which an operator sits for operation, and a mechanical room 3B which is positioned behind the cab 3A and accommodates various equipment such as an engine 17 (not shown in FIG. 1, see FIG. 2A) serving as a prime mover, hydraulic pumps 8, 9 (same as above), and a control valve unit 7. The upper swing structure 3 is mounted on the lower travel structure in a horizontally rotatable manner.

The boom 1*a,* an arm 1*b* and a bucket 1*c* are driven respectively by a boom hydraulic cylinder 11, an arm hydraulic cylinder 12 and a bucket hydraulic cylinder 13. The lower travel structure 2 is driven by left and right track hydraulic motors 14, 15 (only 14 shown in FIG. 1, see FIGS. 2A and 2B as well) for traveling. The upper swing structure 3 is driven by a swing hydraulic motor (not shown in FIG. 1, see FIG. 2A) to horizontally rotate with respect to the lower travel structure 2.

Control lever devices 62, 63, 64, 65, 66 and 67 (not shown in FIG. 1, see FIGS. 2A and 2B) serving as operating means are provided in the cab 3A. The operator sitting in the cab 3A operates control levers 62*a* to 67*a* of the control lever devices 62 to 67, as required, whereupon the corresponding hydraulic actuators, such as the aforesaid hydraulic motors and hydraulic cylinders, are driven to travel the hydraulic excavator and perform required works.

Figure 2A:
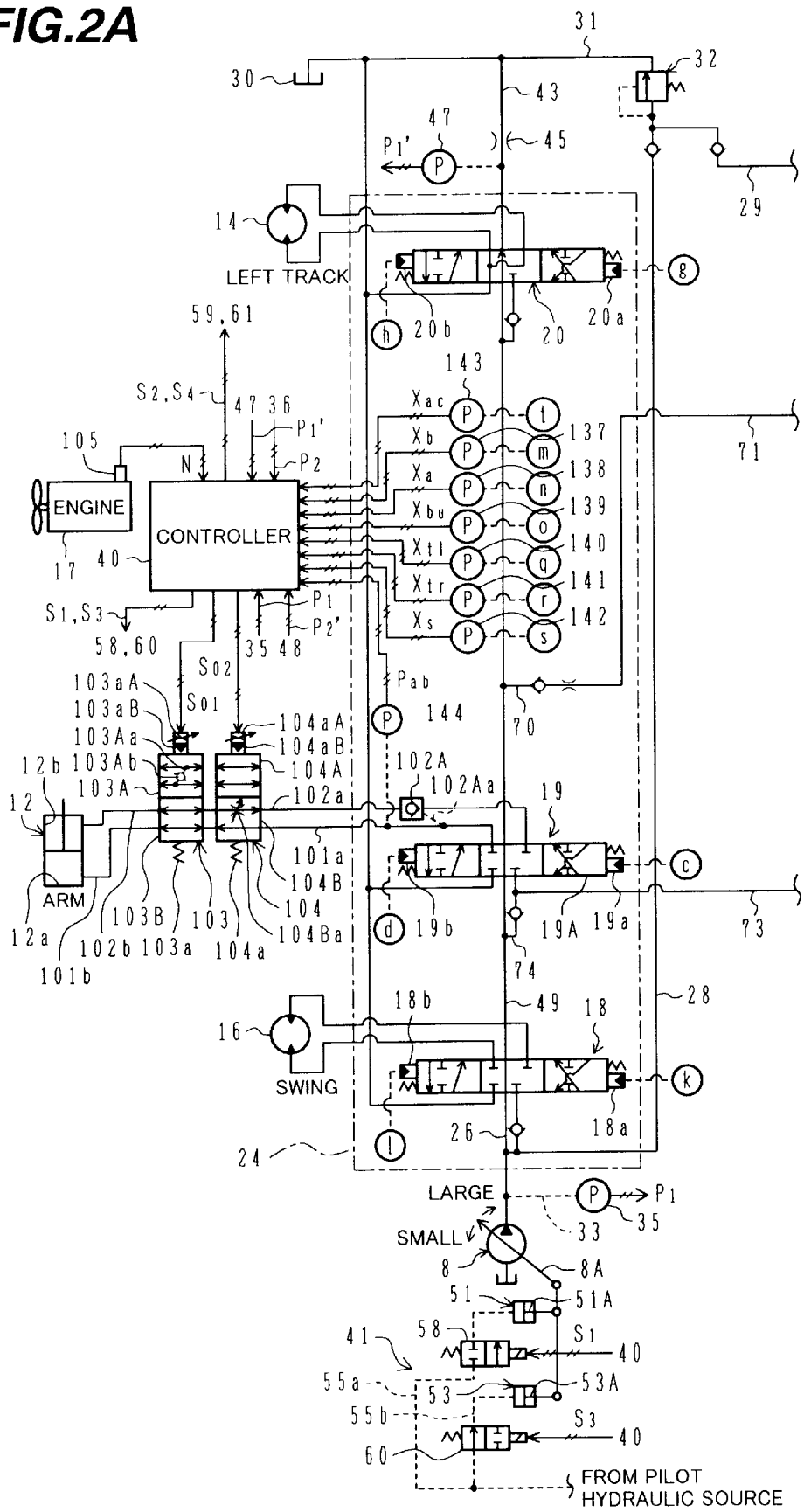
FIGS. 2A and 2B are hydraulic circuit diagram representing a construction of a hydraulic drive system including various hydraulic actuators, which is equipped in the hydraulic excavator shown in FIG. 1.
Figure 2B:
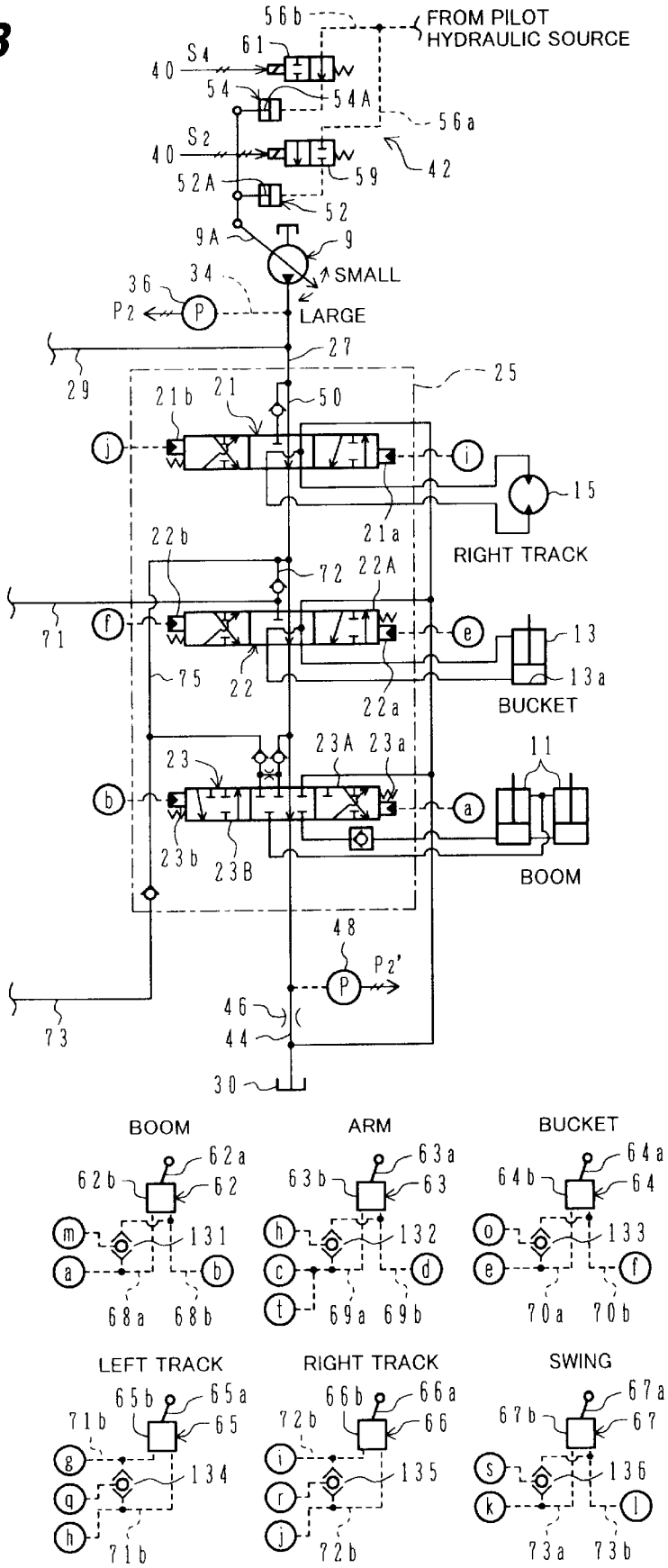

FIGS. 2A and 2B are hydraulic circuit diagram representing a construction of a hydraulic drive system including various hydraulic actuators, which is equipped in the hydraulic excavator shown in FIG. 1.

Referring to FIGS. 2A and 2B, the hydraulic drive system comprises two first and second hydraulic pumps 8, 9; six hydraulic actuators 11 to 16 including the boom hydraulic cylinder 11, the arm hydraulic cylinder 12 and the bucket hydraulic cylinder 13 supplied with a hydraulic fluid from the hydraulic pumps 8, 9 for driving the boom 1*a,* the arm 1*b* and the bucket 1*c,* respectively; six control valves 18 to 23 for controlling directions and flow rates in and at which the hydraulic fluid is supplied from the hydraulic pumps 8, 9 to the six hydraulic actuators 11 to 16; and regulators 41, 42 to which a pilot pressure is introduced from a not-shown pilot hydraulic source (e.g., an auxiliary hydraulic pump driven by the engine 17) for regulating tilting angles (i.e., pump delivery rates) of swash plates 8A, 9A of the first and second hydraulic pumps 8, 9.

In addition to the boom hydraulic cylinder 11, the arm hydraulic cylinder 12 and the bucket hydraulic cylinder 13, the hydraulic actuators 11 to 16 include the left and right track motors 14, 15 for driving the lower travel structure 2 (see FIG. 1) of the hydraulic excavator, and a swing motor 16 for rotating the upper swing structure 3 (see FIG. 1) with respect to the lower travel structure 2.

The control valves 18 to 23 are each a center bypass selector valve, and are divided into two valve groups, i.e., a first valve group 24 and a second valve group 25. The control valves are constructed, for example, into an integral unit for each valve group and are incorporated in the control valve unit 7 (see FIG. 1).

The first valve group 24 is made up of a swing control valve 18 connected to the swing motor 16 among the hydraulic actuators 11 to 16, an arm control valve 19 connected to the arm hydraulic cylinder 12, and a left-track control valve 20 connected to the left-track hydraulic motor 14.

The second valve group 25 is made up of a right-track control valve 21 connected to the right-track hydraulic motor 15 among the hydraulic actuators 11 to 16, a bucket control valve 22 connected to the bucket hydraulic cylinder 13, and a boom control valve 23 connected to a pair of boom hydraulic cylinders 11, 11.

The hydraulic pumps 8, 9 are variable displacement pumps driven by the engine 17 in common (although the hydraulic pumps 8, 9 are shown as being remote from the engine 17 in FIGS. 2A and 2B for the convenience of illustration). Specifically, the hydraulic pumps 8, 9 are constituted as a first hydraulic pump 8 for delivering the hydraulic fluid to the first valve group 24 and a second hydraulic pump 9 for delivering the hydraulic fluid to the second valve group 25.

In this embodiment, the swing control valve 18, the arm control valve 19 and the left-track control valve 20 of the first valve group 24 are interconnected in tandem so that the hydraulic fluid from the first hydraulic pump 8 is supplied to the swing motor 16, the arm hydraulic cylinder 12 and the left-track hydraulic motor 14 with higher priority in the order named.

Also, in the second valve group 25, the right-track control valve 21 is connected in tandem to both the bucket control valve 22 and the boom control valve 23 so that the right-track control valve 21 allows the hydraulic fluid from the second hydraulic pump 9 to be supplied to the right-track hydraulic motor 15 with the highest priority. The relationship in connection to the second hydraulic pump 9 between the bucket control valve 22 and the boom control valve 23 varies depending on the operation of the boom hydraulic cylinder 11. More specifically, during the boom raising operation (when the boom control valve 23 is shifted to a shift position 23A described later), the bucket control valve 22 and the boom control valve 23 are connected in tandem so that the bucket control valve 22 allows the hydraulic fluid from the second hydraulic pump 9 to be supplied to the bucket cylinder 13 with higher priority than the boom control valve 23 (exactly speaking, the boom control valve 23 in the shift position 23A). During the boom lowering operation (when the boom control valve 23 is shifted to a shift position 23B described later), the bucket control valve 22 and the boom control valve 23 (exactly speaking, the boom control valve 23 in the shift position 23B) are connected in parallel.

A bucket communicating line 71 is branched at one end from a center bypass line 49 of the first valve group 24 at a point downstream of the arm control valve 19. The other end of the bucket communicating line 71 is connected to a bucket meter-in line 72 branched from a center bypass line 50 of the second valve group 25 at a point downstream of the right-track control valve 21. With such an arrangement, during the bucket sole operation, the bucket hydraulic cylinder 13 is supplied with both of the hydraulic fluid from the second hydraulic pump 9 via a delivery line 27, the center bypass line 50 and the bucket meter-in line 72, and the hydraulic fluid from the first hydraulic pump 8 via a delivery line 26, the center bypass line 49, the bucket communicating line 71 and the bucket meter-in line 72 in a joined manner.

Similarly, an arm communicating line 73 is branched at one end from a boom-lowering meter-in line 75 that is branched from the center bypass line 50 of the second valve group 25 at a point downstream of the right-track control valve 19. The other end of the arm communicating line 73 is connected to an arm meter-in line 74 branched from the center bypass line 49 of the first valve group 24 at a point downstream of the swing control valve 18. With such an arrangement, during the arm sole operation, the arm hydraulic cylinder 12 is supplied with both of the hydraulic fluid from the first hydraulic pump 8 via the delivery line 26, the center bypass line 49 and the arm meter-in line 74 and the hydraulic fluid from the second hydraulic pump 9 via the delivery line 27, the center bypass line 50, the boom-lowering meter-in line 75, the arm communicating line 73 and the arm meter-in line 74 in a joined manner.

During the arm and bucket combined operation, since the arm control valve 19 is shifted to a shift position 19A, the hydraulic fluid is not introduced to the side of the bucket communicating line 71, whereas the hydraulic fluid is introduced to the arm communicating line 73 via the boom-lowering meter-in line 75. Therefore, the arm hydraulic cylinder 12 is supplied with the hydraulic fluid from both the first hydraulic pump 8 and the second hydraulic pump 9. At this time, the bucket hydraulic cylinder 13 is supplied with the hydraulic fluid from the second hydraulic pump 9 via the bucket meter-in line 72. Thus, the arm control valve 19 and the bucket control valve 22 are connected in parallel to the second hydraulic pump 9.

Throttles 45, 46 are provided respectively in lines 43, 44 through which the control valve 20, 23 are connected to a hydraulic reservoir 30. Upstream of the throttles 45, 46, pressure sensors 47, 48 are provided respectively to detect pressures (negative control pressures P1', P2') generated by the throttles 45, 46. The control valves 18 to 23 are each a center bypass valve, as described above, and the flow rate of the hydraulic fluid passing through each center bypass line varies depending on respective input amounts by which the control valves 18 to 23 are operated. When the control valves 18 to 23 are all in neutral positions, i.e., when the flow rates demanded for the hydraulic pumps 8, 9 are small, most of the hydraulic fluids delivered from the hydraulic pumps 8, 9 flows through the lines 43, 44 and hence the negative control pressures P1', P2' are raised. Conversely, when the control valves 18 to 23 are operated to be open, i.e., when the flow rates demanded for the hydraulic pumps 8, 9 are large, the flow rates of the hydraulic fluids passing through the lines 43, 44 are reduced to such an extent as corresponding to the flow rates of the hydraulic fluids introduced to the respective actuator sides, and hence the negative control pressures P1', P2' are lowered. In this embodiment, as described later in detail, tilting angles θ1, θ2 of the swash plates 8A, 9A of the hydraulic pumps 8, 9 are controlled depending on variations of the negative control pressures P1', P2' detected by the pressure sensors 47, 48.

Further, the hydraulic drive system of this embodiment comprises a plurality of control lever devices including a boom control lever device 62, an arm control lever device 63, a bucket control lever device 64, a left-track control lever device 65, a right-track control lever device 66, and a swing control lever device 67, which serve as operating means provided corresponding to the hydraulic actuators 11 to 16 for instructing operations of respective driven members, i.e., the boom 1*a*, the arm 1*b*, the bucket 1*c*, the lower travel structure 2, and the upper swing structure 3.

The following description is made by taking the boom control lever device 62 as an example. The boom control lever device 62 is of the hydraulic pilot type and operates the corresponding control valve 23 for driving it with a pilot pressure from the pilot hydraulic source (not shown). The boom control lever device 62 is made up of the control lever 62*a* operated by the operator, and a pressure reducing valve 62*b* for producing a pilot pressure corresponding to the amount and direction by and in which the control lever 62*a* is operated. Though not shown in detail, the primary port side of the pressure reducing valve 62*b* is connected to the pilot hydraulic source. The secondary port side of the pressure reducing valve 62*b* is connected to driving sectors 23*a*, 23*b* of the corresponding boom control valve 23 via pilot lines 68*a* and 68*b*. With such an arrangement, the control valve 23 is shifted in accordance with an operation signal from the boom control lever device 62 to control the direction and flow rate in and at which the hydraulic fluid is supplied from the hydraulic pump 9 to the boom hydraulic cylinder 11.

The other control lever devices 63, 64, 65, 66 and 67 are each of the same construction. Respective pilot pressures depending on operations of the control levers 63*a*, 64*a*, 65*a*, 66*a* and 67*a* are produced by pressure reducing valves 63*b*, 64*b*, 65*b*, 66*b* and 67*b*, and are introduced to corresponding driving sectors 19*a*, 22*a*, 20*a*, 21*a* and 18*a* (or driving sectors 19*b*, 22*b*, 20*b*, 21*b* and 18*b*) via pilot lines 69*a*, 70*a*, 71*a*, 72*a* and 73*a* (or pilot lines 69*b*, 70*b*, 71*b*, 72*b* and 73*b*). The control valves 19, 22, 20, 21 and 18 are thereby shifted to control the respective directions and flow rates in and at which the hydraulic fluids are supplied from the hydraulic pumps 8, 9 to the corresponding hydraulic actuators 12, 13, 14, 15 and 16.

The regulators 41, 42 comprise cylinders 51, 52 for input torque limiting control, and cylinders 53, 54 for negative control. The cylinders 51, 52, 53 and 54 have pistons 51A, 52A, 53A and 54A, respectively. When the pistons 51A, 53A are moved to the right in FIGS. 2A and 2B, the tilting angle of the swash plate 8A of the first hydraulic pump 8 is changed so as to reduce the delivery rate of the hydraulic pump 8. When the pistons 51A, 53A are moved to the left in FIGS. 2A and 2B, the tilting angle of the swash plate 8A of the first hydraulic pump 8 is changed so as to increase the delivery rate of the hydraulic pump 8. Similarly, when the pistons 52A, 54A are moved to the left in FIGS. 2A and 2B, the delivery rate of the hydraulic pump 9 is reduced, and when they are moved to the right in FIGS. 2A and 2B, the delivery rate of the hydraulic pump 9 is increased.

In the above arrangement, control pressures based on the pilot pressure from the pilot hydraulic source is introduced to the respective bottom sides of the cylinders 51, 52, 53 and 54 via pilot lines 55*a*, 56*a*, 55*b* and 56*b*. When the control pressures are high, the pistons 51A, 53A are moved to the right in FIGS. 2A and 2B and the pistons 52A, 54A are moved to the left in FIGS. 2A and 2B, whereby the delivery rates of the first and second hydraulic pumps 8, 9 are reduced. When the control pressures are low, the pistons 51A, 53A are moved to the left in FIGS. 2A and 2B and the pistons 52A, 54A are moved to the right in FIGS. 2A and 2B, whereby the delivery rates of the first and second hydraulic pumps 8, 9 are increased.

Solenoid control valves 58, 59, 60 and 61 driven by drive signals S1, S2, S3 and S4 (described later) from a controller 40 are provided respectively in the pilot lines 55*a,* 56*a,* 55*b* and 56*b* leading from the pilot hydraulic source to the cylinders 51, 52, 53 and 54. The solenoid control valves 58, 59, 60 and 61 establish communication through the pilot lines 55*a,* 56*a,* 55*b* and 56*b* in accordance with output current values of the drive signals S1, S2, S3 and S4.

More specifically, the solenoid control valves 58, 59 establish communication through the pilot lines 55*a,* 56*a* at a larger opening and raises the control pressures supplied to the cylinders 51, 52 as the output current values of the drive signals S1, S2 increase, and they cut off the pilot lines 55*a,* 56*a* to make zero (0) the control pressures supplied to the cylinders 51, 52 when the output current values become zero (0). Also, the solenoid control valves 60, 61 establish communication through the pilot lines 55*b,* 56*b* at a larger opening and raises the control pressures supplied to the cylinders 53, 54 as the output current values of the drive signals S3, S4 decrease, and they cut off the pilot lines 55*b,* 56*b* to make zero (0) the control pressures supplied to the cylinders 53, 54 when the output current values become zero (0).

Figure 3:
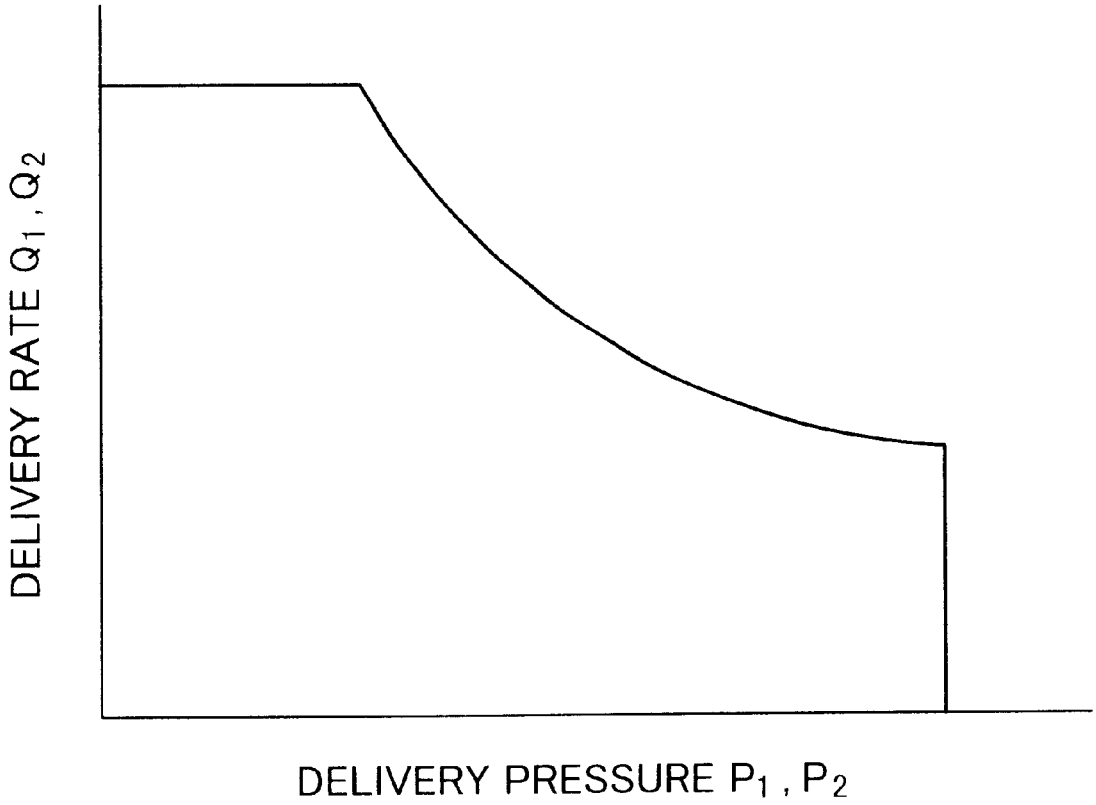
FIG. 3 is a P-Q graph representing the relationship between a delivery pressure and a delivery rate of each of first and second hydraulic pumps, which is realized as a result of input torque limiting control performed by a regulator shown in FIGS. 2A and 2B.

For the solenoid control valves 58, 59 associated with the cylinders 51, 52 for input torque limiting control, as described later in more detail, the controller 40 increases the output current values of the drive signals S1, S2 as delivery pressures P1, P2 of the first and second hydraulic pumps 8, 9 rise beyond predetermined levels. Therefore, when the delivery pressures P1, P2 of the first and second hydraulic pumps 8, 9 exceed beyond the predetermined levels, the delivery rates of the first and second hydraulic pumps 8, 9 are limited and the tilting angles of the swash plates 8A, 9A are controlled so that the loads of the first and second hydraulic pumps 8, 9 will not exceed the output torque of the engine 17 (well-known input torque limiting control). FIG. 3 is a P-Q graph representing one example of the relationship between delivery pressures P1, P2 and delivery rates Q1, Q1 of the first and second hydraulic pumps 8, 9, which is realized as a result of that input torque limiting control.

On the other hand, for the solenoid control valves 60, 61 associated with the cylinders 53, 54 for negative control, control is performed as follows. When the negative control pressures P1', P2' detected by the pressure sensors 47, 48 are high, the controller 40 reduces the output current values of the drive signals S3, S4 supplied to the solenoid control valves 60, 61, as described later in more detail. Conversely, when the negative control pressures P1', P2' are low, the controller 40 increases the output current values of the drive signals S3, S4 supplied to the solenoid control valves 60, 61. Therefore, at smaller flow rates demanded for the first and second hydraulic pumps 8, 9, the tilting angles θ1, θ2 of the first and second hydraulic pumps 8, 9 are reduced to decrease the delivery rates. At larger flow rates demanded for the first and second hydraulic pumps 8, 9, the tilting angles θ1, θ2 of the first and second hydraulic pumps 8, 9 are increased to increase the delivery rates. Thus, the so-called negative control is performed.

In a line 31 connecting between the hydraulic reservoir 30 and lines 28, 29 branched from the delivery lines 26, 27 of the hydraulic pumps 8, 9, there is provided a relief valve 32 that is opened when the pressure in one of the delivery lines 26, 27 exceeds beyond a setting relief pressure determined depending on the biasing force of a spring 32*a*. The relief valve 32 serves to specify a maximum delivery pressure of each hydraulic pump 8, 9. The delivery pressures P1, P2 of the hydraulic pumps 8, 9 are detected by pressure sensors 35, 36 through lines 33, 34 branched from the delivery lines 26, 27, and detection signals P1, P2 are inputted to the controller 40.

Figure 4:
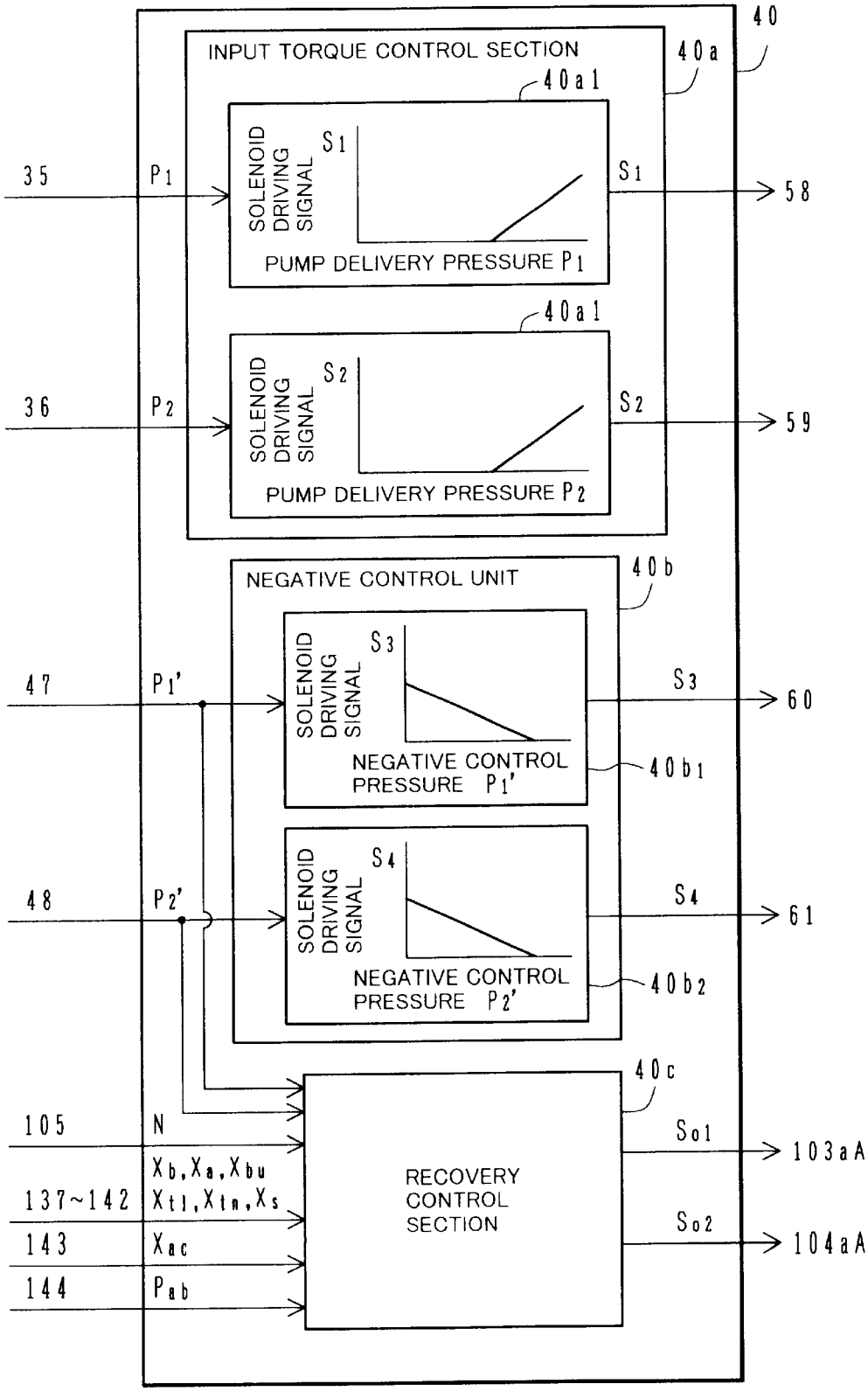
FIG. 4 is a functional block diagram representing functions of a controller shown in FIG. 2A.

FIG. 4 shows functions of the controller 40. The controller 40 comprises an input torque control section 40*a,* a negative control section 40*b,* and a recovery control section 40*c*.

The input torque control section 40*a* includes function generators 40*a*1, 40*a*2. Based on tables shown in FIG. 4, the function generators 40*a*1, 40*a*2 generate the drive signals S1, S2 supplied to the solenoid control valves 58, 59 for the input torque limiting control depending on the delivery pressures P1, P2 of the first and second hydraulic pumps 8, 9 detected by the pressure sensors 35, 36.

The negative control section 40*b* includes function generators 40*b*1, 40*b*2. Based on tables shown in FIG. 4, the function generators 40*b*1, 40*b*2 generate the drive signals S3, S4 supplied to the solenoid control valves 60, 61 depending on the negative control pressures P1', P2' detected by the pressure sensors 47, 48.

The recovery control section 40*c* is described later.

The hydraulic recovery system of this embodiment is provided in the hydraulic drive system having the above-described construction. The hydraulic recovery system is primarily intended to perform, in the arm-crowding and bucket-crowding combined operation (see two-dot-chain lines in FIG. 1) that is frequently performed in excavation, the arm crowding operation at a higher speed during a stroke until the bucket reaches the ground surface. The hydraulic recovery system comprises bottom-side lines 101*a,* 101*b* for supplying the hydraulic fluid to a bottom-side hydraulic chamber 12*a* of the arm hydraulic cylinder 12 and rod-side lines 102*a,* 102*b* for draining the hydraulic fluid from a rod-side hydraulic chamber 12*b* of the arm hydraulic cylinder 12, these lines 101*a,* 101*b,* 102*a* and 102*b* being connected between the arm control valve 19 and the arm hydraulic cylinder 12; a recovery valve 103 and a throttle valve 104 both provided in the bottom-side lines 101*a,* 101*b* and the rod-side lines 102*a,* 102*b;* the recovery control section 40*c* (see FIG. 4) incorporated in the controller 40; a revolution speed sensor 105 for detecting a revolution speed N of the engine 17 and applying a detected signal to the controller's recovery control section 40*c;* pressure sensors 137, 138, 139, 140, 141 and 142 for detecting maximum input amount signals (pilot pressures, hereinafter referred to simply as "input amounts" or "input amount signals") Xb, Xa, Xbu, Xtl, Xtr and Xs of the boom control lever device 62, the arm control lever device 63, the bucket control lever device 64, the left-track control lever device 65, the right-track control lever device 66, and the swing control lever device 67 through shuttle valves 131, 132, 133, 134, 135 and 136, and outputting respective detected signals to the controller 40; a pressure sensor 143 for detecting a input amount signal (pilot pressure) Xac of the arm control lever device 63 in the arm-crowding direction, and outputting a detected signal to the controller 40; and a pressure sensor 144 for detecting a pressure (bottom-side load pressure) Pab in the bottom-side lines 101*a,* 101*b* leading to the bottom-side hydraulic chamber 12*a* of the arm hydraulic cylinder 12, and outputting a detected signal to the controller 40.

The recovery valve 103 and the throttle valve 104 comprise respectively solenoid proportional valves 103*a*A, 104*a*A which receive drive signals S01, S02 (described later) from the controller 40 and a primary pilot pressure from a pilot circuit (not shown) and which serve as electro-hydraulic converting means for outputting secondary pilot pressures in accordance with the inputted drive signals S01, S02; and pilot-operated sectors 103*a*B, 104*a*B to which the respective secondary pilot pressures outputted from the solenoid proportional valves 103*a*A, 104*a*A are applied. The recovery valve 103 and the throttle valve 104 are operated with the respective secondary pilot pressures applied to the pilot-operated sectors 103*a*B, 104*a*B.

More specifically, when the drive signal S01 is turned on, the recovery valve 103 is shifted to a recovery position 103A on the upper side in FIGS. 2A and 2B, whereupon the bottom-side lines 101*a,* 101*b* and the rod-side lines 102*a,* 102*b* are communicated with each other in each side. Further, when the arm control valve 19 is shifted to a shift position 19A on the right side in FIGS. 2A and 2B so that the hydraulic fluid is supplied to the bottom-side hydraulic chamber 12*a* of the arm hydraulic cylinder 12 via the bottom-side lines 101*a,* 101*b* and the hydraulic fluid is drained from the rod-side hydraulic chamber 12*b* via the rod-side lines 102*a,* 102*b,* at least a part of the hydraulic fluid passing through the rod-side lines 102*a,* 102*b* is supplied (returned) to the bottom-side lines 101*a,* 101*b* through a check valve 103Ab and a variable throttle 103Ac (shown in FIG. 11), which are provided in a recovery line 103Aa.

When the drive signal S01 is turned off, the recovery valve 103 is returned to a non-recovery position 103B on the lower side in FIGS. 2A and 2B by the restoring force of a spring 103*a,* whereupon the recovery operation via the recovery line 103Aa is stopped (the bottom-side lines 101*a,* 101*b* and the rod-side lines 102*a,* 102*b* are simply communicated with each other in each side).

Also, when the drive signal S02 is turned on, the throttle valve 104 is shifted to a communicating position 104A on the upper side in FIGS. 2A and 2B, whereupon the bottom-side lines 101*a,* 101*b* and the rod-side lines 102*a,* 102*b* are communicated with each other in each side.

When the drive signal S02 is turned off, the throttle valve 104 is returned to a throttling position 104B on the lower side in FIGS. 2A and 2B by the restoring force of a spring 104*a,* whereupon the rod-side lines 102*a,* 102*b* are communicated with each other through a variable throttle 104Ba. In that condition, when the arm control valve 19 is shifted to the shift position 19A on the right side in FIGS. 2A and 2B so that the hydraulic fluid is drained from the rod-side hydraulic chamber 12*b* of the arm hydraulic cylinder 12 via the rod-side lines 102*a,* 102*b,* the remaining part of the hydraulic fluid drained via the rod-side lines 102*a,* 102*b,* which is not recovered through the recovery circuit 103Aa, is returned to the hydraulic reservoir 30 through the variable throttle 104Ba and a pilot-operated check valve 102A (which is opened at that time with a pilot pressure introduced from the bottom-side line 101*a* via a pilot line 102Aa).

Figure 5:
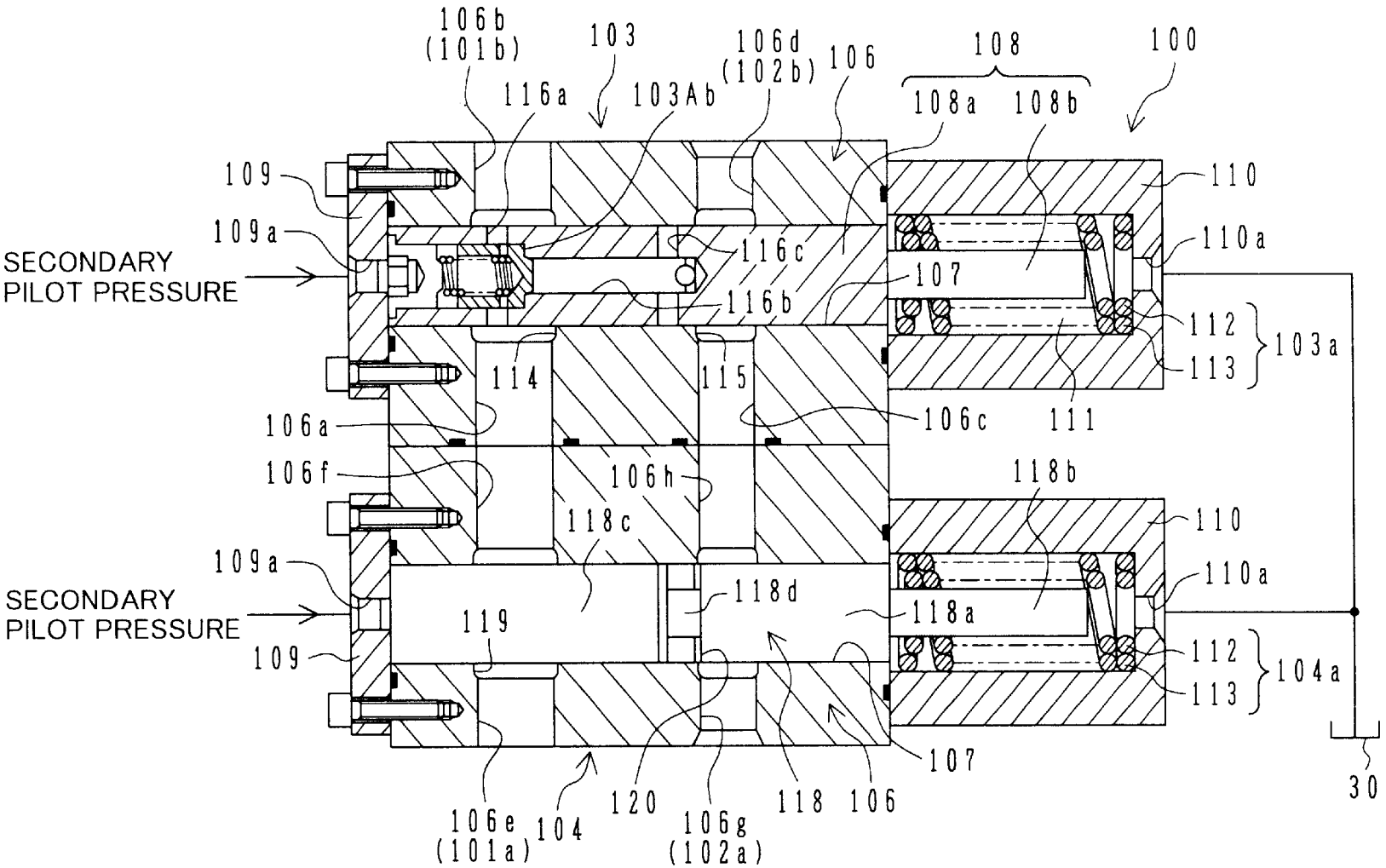
FIG. 5 is a sectional view showing a detailed structure of a recovery valve unit incorporated in the hydraulic recovery system according to one embodiment of the present invention.

FIG. 5 is a sectional view showing a detailed structure (except for the solenoid proportional valves 103*a*A, 104*a*A) of the recovery valve 103 and the throttle valve 104 having the functions outlined above. Referring to FIG. 5, the recovery valve 103 and the throttle valve 104 are constructed into a discrete recovery valve unit 100 in which both the valves 103, 104 are combined with each other to have an integral structure. Note that, as described later, the recovery valve 103 and the throttle valve 104 may be of a separated structure and connected to each other through appropriate lines.

The recovery valve 103 comprises a valve body 106; a through bore 107 axially formed in the valve body 106; a recovery valve spool 108 slidably disposed in the through bore 107 and made up of a large-diameter portion 108*a* and a small-diameter portion 108*b;* a cover 109 disposed so as to close a one-side axial end (left end in FIG. 5) of the through bore 107 and to restrict movement of the recovery valve spool 108, and having a pilot inlet port 109*a* through which the aforesaid secondary pilot pressure is introduced; a spring case 101 attached to an opposite-side axial end (right end in FIG. 5) of the valve body 106 and forming therein a spring chamber 111 communicating with the through bore 107; a screw hole 101*a* formed at an opposite-side axial end (right end in FIG. 5) of the spring case 101 and communicating with the hydraulic reservoir 30; the spring 103*a* comprising an inner spring 112 positioned around the small-diameter portion 108*b* of the recovery valve spool 108 and an outer spring 113 positioned around the inner spring 112, the springs 112, 113 being both disposed in the spring chamber 111 for biasing the large-diameter portion 108*a* of the recovery valve spool 108 to the one side in the axial direction (left in FIG. 5); and the check valve 103Ab disposed in the large-diameter portion 108*a* of the recovery valve spool 108.

In the valve body 106, there are formed ports 106*a,* 106*b* extended perpendicularly to and in communication with the through bore 107 and constituting a part of the bottom-side lines 101*a,* 101*b* (see numerals in parentheses), and ports 106*c,* 106*d* extended perpendicularly to and in communication with the through bore 107 and constituting a part of the rod-side lines 102*a,* 102*b* (see numerals in parentheses). Lands 114 communicating with the ports 106*a,* 106*b* at the outer peripheral side of the large-diameter portion 108*a* of the recovery valve spool 108 (i.e., corresponding to the bottom side of the arm hydraulic cylinder 12), and lands 115 communicating with the ports 106*c,* 106*d* (i.e., corresponding to the rod side of the arm hydraulic cylinder 12) are formed to be open widely in the radial direction so that flows of the hydraulic fluid through the ports 106*a,* 106*b;* 106*c,* 106*d* will not impeded as far as possible.

The large-diameter portion 108*a* of the recovery valve spool 108 has ports 116*a,* 116*b* and 116*c* formed therein to constitute the recovery line 103Aa extending from the side of the ports 106*a,* 106*b* to the side of the ports 106*c,* 106*d.* Since the check valve 103Ab is provided on the rod side of the port 116*b,* the hydraulic fluid is prevented from flowing backward from the side of the ports 106*a,* 106*b* to the side of the ports 106*c,* 106*d.*

In the above-described structure, the position of the recovery valve spool 108 is determined under balance among forces imposed by the pilot pressure introduced to the through bore 107 via the inlet port 109*a* of the cover 109 (i.e., the secondary pilot pressure supplied from the solenoid proportional valve 103*a*A) and both the inner spring 112 and the outer spring 113 disposed in the spring case 101. Specifically, the recovery valve spool 108 is moved to the right in FIG. 5 against the resilient force imposed by both the inner spring 112 and the outer spring 113 in proportion to the magnitude of the secondary pilot pressure supplied from the solenoid proportional valve 103*a*A, whereupon an area of the port 116*c* exposed to the lands 115 is increased. As a result, the overall opening area of the recovery line 103Aa is enlarged and hence the flow rate of the hydraulic fluid passing through the recovery line 103Aa (i.e., the recovery flow rate) is increased.

The throttle valve 104 comprises a valve boy 106, a through bore 107, a cover 109, a spring case 110, an inner spring 112, and an outer spring 113, which are basically similar to the corresponding components of the recovery valve 103.

A throttle valve spool 118 made up of a first large-diameter portion 118*a,* a first small-diameter portion 118*b,* a second large-diameter portion 118*c* and a second small-diameter portion 118*d* is slidably disposed in the through bore 107. An inner spring 112 and an outer spring 113 for biasing the throttle valve spool 118 constitute the aforesaid spring 104*a*.

In the valve body 106, there are formed ports 106*e,* 106*f* constituting a part of the bottom-side lines 101*a,* 101*b* (see numerals in parentheses), and ports 106*g,* 106*h* constituting a part of the rod-side lines 102*a,* 102*b* (see numerals in parentheses). Also, lands 119 for communicating the port 106*e* and the port 106*f* with each other are formed to be open widely in the radial direction. On the other hand, lands 120 for communicating the port 106*g* and the port 106*h* with each other are formed to have substantially the same diameter as the through bore 107 (i.e., to be open very slightly in the radial direction).

In the above-described structure, the position of the throttle valve spool 118 is determined under balance among forces imposed by the pilot pressure introduced to the through bore 107 via the inlet port 109*a* of the cover 109 (i.e., the secondary pilot pressure supplied from the solenoid proportional valve 104*a*A) and both the inner spring 112 and the outer spring 113 disposed in the spring case 110. Specifically, the throttle valve spool 118 is moved to the right in FIG. 5 against the resilient force imposed by both the inner spring 112 and the outer spring 113 in proportion to the magnitude of the secondary pilot pressure supplied from the solenoid proportional valve 104*a*A, whereupon an area of the small-diameter portion 118*d* exposed to the lands 120 is increased. As a result, the opening area of a passage communicating the ports 106*g,* 106*h* with each other is enlarged and hence the flow rate of the hydraulic fluid passing through the ports 106*g,* 106*h* is increased.

Figure 6:
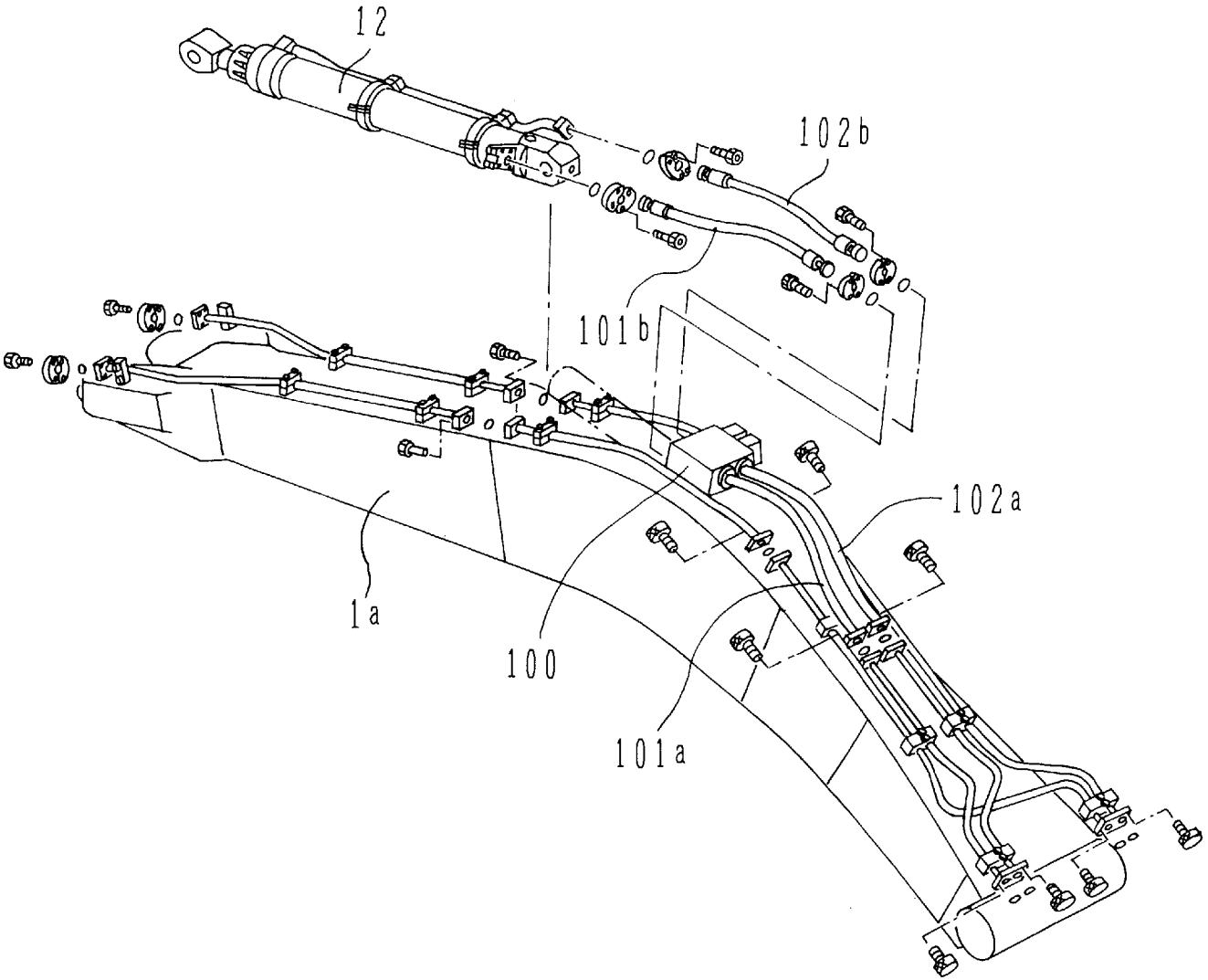
FIG. 6 is an enlarged perspective exploded view of a principal part of FIG. 1, showing a mount position of the recovery valve unit incorporated in the hydraulic recovery system according to one embodiment of the present invention.

The discrete recovery valve unit 100 having the above-described construction is disposed in the bottom-side lines 101*a,* 101*b* and the rod-side lines 102*a,* 102*b* connecting the control valve unit 7, in which first valve group 24 including the arm control valve 19 is incorporated, and the arm hydraulic cylinder 12. In this embodiment, as shown in FIG. 1 and FIG. 6 that is an enlarged perspective exploded view of a principal part of FIG. 1, the discrete recovery valve unit 100 is disposed on the boom 1*a* (more exactly speaking, at a position closer to the arm hydraulic cylinder 12 than the middle between the control valve unit 7 and the arm hydraulic cylinder 12). Alternatively, the discrete recovery valve unit 100 may be positioned closer to the arm hydraulic cylinder 12 such that it is directly attached to the arm hydraulic cylinder 12.

The recovery control section 40*c* of the controller 40 functions as control means for controlling the opening area of the variable throttle provided in the recovery position 103A of the recovery valve 103 and the opening area of the variable throttle 104Ba provided in the throttling position 104B of the throttle valve 104 depending on the actuator flow rate of the hydraulic fluid supplied from the first hydraulic pump 8 to the arm hydraulic cylinder 12.

FIGS. 7, 8, 10 and 12 are flowcharts representing control steps executed in the recovery control section 40*c* as the most important feature of this embodiment. The control in the recovery control section 40*c* is, as described above, primarily intended to operate the arm at a higher speed in the arm crowding operation during a stroke until the bucket reaches the ground surface.

Figure 7:
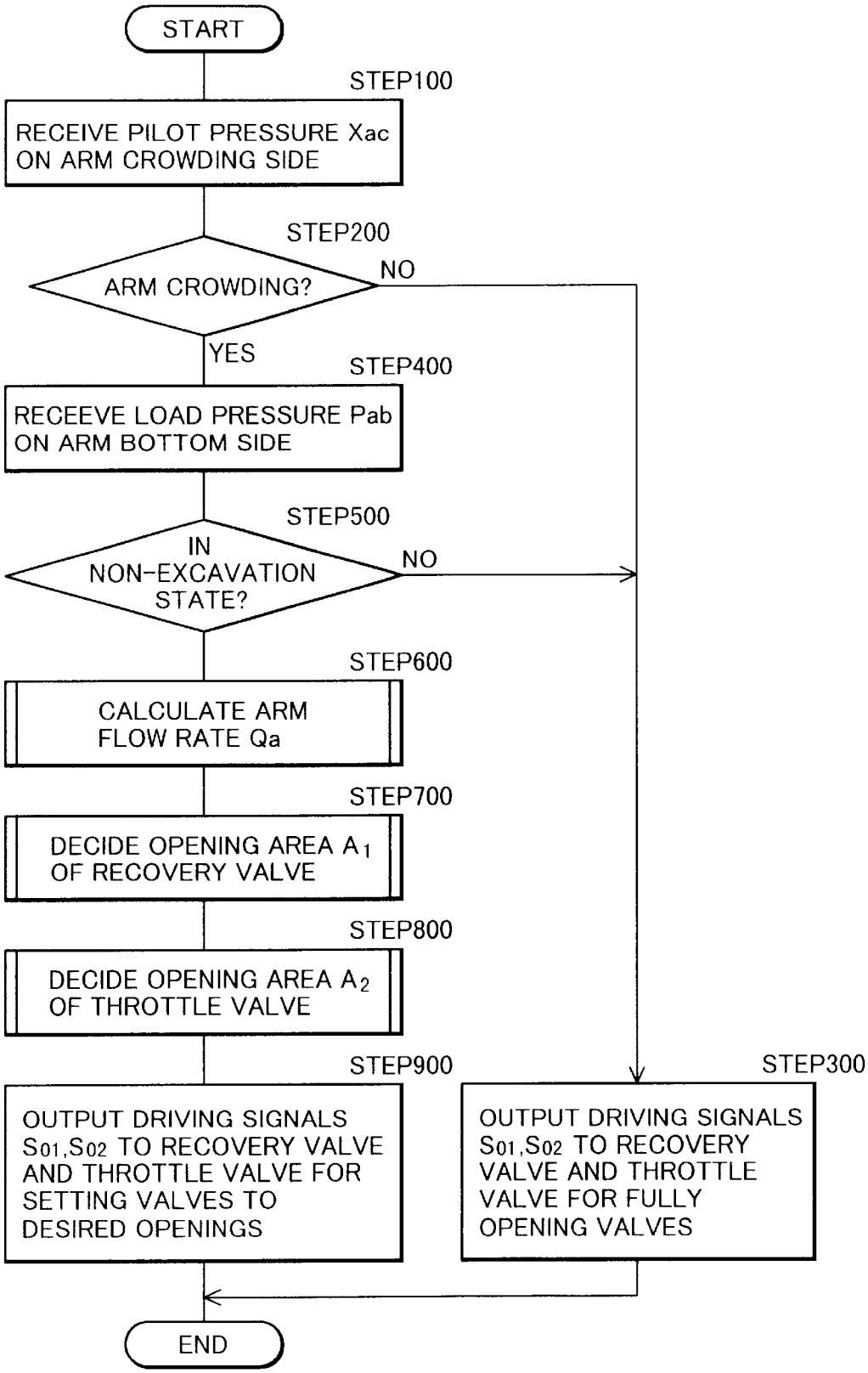
FIG. 7 is a flowchart representing control steps executed by a recovery control section of the controller incorporated in the hydraulic recovery system according to one embodiment of the present invention.

Referring to FIG. 7, the recovery control section 40*c* of the controller 40 first receives, in step 100, the input amount signal Xac in the arm crowding direction detected by the pressure sensor 143. Then, in step 200, it determines based on the detected input amount signal Xac whether the arm crowding operation is performed. Practically, it determines whether Xac exceeds a predetermined threshold stored and held in the recovery control section 40*c* beforehand (the predetermined threshold may be stored in any other suitable functioning unit of the controller 40 or may be inputted each time the operation is started). As an alternative, another pressure sensor for detecting a input amount signal in the arm dumping direction may be provided separately, and the recovery control section 40*c* may also determine whether a detected signal of that pressure sensor is not larger than a predetermined threshold set close to zero (0).

If the above determination condition is not satisfied, this is determined as indicating that the arm crowding operation is not performed. Then, the control flow proceeds to step 300 where the recovery control section 40 makes zero (0) the current value of the drive signal S01 supplied to the solenoid proportional valve 103*a*A of the recovery valve 103 and increases (e.g., maximizes) the current value of the drive signal S02 supplied to the solenoid proportional valve 104*a*A of the throttle valve 104. With those settings, the recovery valve 103 is returned to the non-recovery position 103B by the restoring force of the spring 103*a* so as to take a fully open state (state where no recovery is performed through the recovery line 103Aa), and the throttle valve 104 is shifted to the communicating position 104A so as to take a fully open state. Thus, the bottom-side lines 101*a,* 101*b* and the rod-side lines 102*a,* 102*b* are simply communicated with each other in each side without any throttling and recovery.

If the above determination condition in step 200 is satisfied, this is determined as indicating that the arm crowding operation is performed, and the control flow proceeds to step 400.

In step 400, the recovery control section 40*c* receives the bottom-side load pressure Pab in the bottom-side hydraulic chamber 12*a* of the arm hydraulic cylinder 12 detected by the pressure sensor 144. Then, in step 500, it determines based on the detected bottom-side load pressure Pab whether the excavator is in a non-excavation state. Practically, it determines whether Pab is less than a predetermined threshold (value corresponding to standard excavation work) stored and held in the recovery control section 40*c* beforehand (the predetermined threshold may be stored in any other suitable functioning unit of the controller 40 or may be inputted each time the operation is started).

If the above determination condition is not satisfied, this is determined as indicating that the excavator is not in the non-excavation state (i.e., it is under excavation). Then, the control flow proceeds to step 300 where the recovery valve 103 and the throttle valve 104 are fully opened. If the above determination condition is satisfied, this is determined as indicating that the excavator is in the non-excavation state, and the control flow proceeds to step 600.

Figure 8:
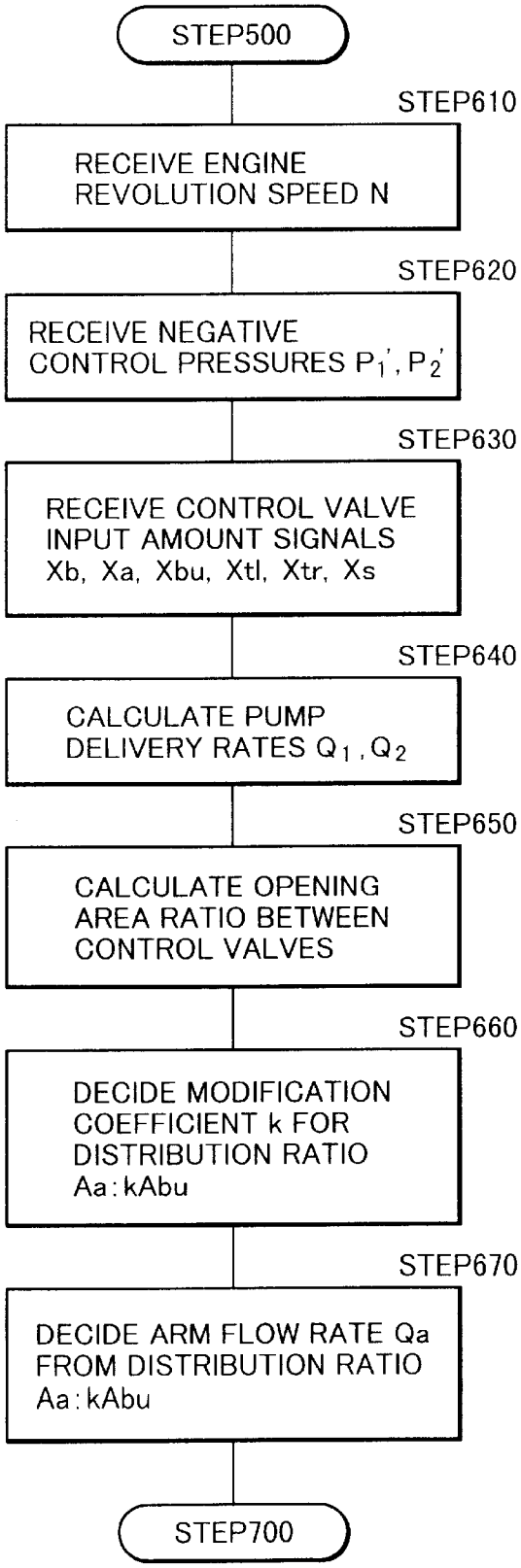
FIG. 8 is a flowchart representing control steps executed by the recovery control section of the controller incorporated in the hydraulic recovery system according to one embodiment of the present invention.

In step 600, the recovery control section 40*c* calculates the actuator flow rate (arm flow rate) of the hydraulic fluid supplied to the bottom-side hydraulic chamber 12*a* of the arm hydraulic cylinder 12 from the first and second hydraulic pumps 8, 9 via the bottom-side lines 101*a*, 101*b*. FIG. 8 is a flowchart representing details of step 600.

Referring to FIG. 8, the recovery control section 40*c* first receives, in step 610, the engine revolution speed N of the revolution speed sensor 105. Then, in step 620, it receives the negative control pressures P1', P2' detected by the pressure sensors 47, 48.

Subsequently, in step 630, the recovery control section 40*c* receives the maximum input amount signals Xb, Xa, Xbu, Xtl, Xtr and Xs for the control valves 18, 19, 20, 21, 22 and 23.

The control flow then proceeds to step 640 where, based on the negative control pressures P1', P2' received in above step 620, the recovery control section 40*c* calculates the tilting angles θ1, θ2 of the swash plates 8A, 9A of the first and second hydraulic pumps 8, 9 in accordance with the characteristics described above. From the thus-calculated tilting angles θ1, θ2 and the engine revolution speed N received in above step 610, the delivery rate Q1 of the first hydraulic pump 8 and the delivery rate Q2 of the second hydraulic pump 9 are calculated (or indirectly detected).

When performing in the hydraulic drive system the so-called positive control where the tilting angles θ1, θ2 of the swash plates 8A, 9A of the first and second hydraulic pumps 8, 9 are controlled in accordance with the input amount signals Xb, Xa, Xbu, Xtl, Xtr and Xs, the tilting angles θ1, θ2 are determined based on the preset correlation between the input amounts and the tilting angles by using Xb, Xa, Xbu, Xtl, Xtr and Xs. Therefore, Q1, Q2 may be obtained from the thus-determined tilting angles θ1, θ2 and the engine revolution speed N. Also, when performing the so-called load sensing control, it is enough to employ a tilting angle that is uniquely in accordance with the load sensing differential pressure.

Further, when performing only the input torque limiting control without performing the positive control, the negative control, the load sensing control, etc. in accordance with demanded flow rates, since the excavator is in the non-excavation state and the load is very small, the hydraulic pumps 8, 9 are each in a state represented by a horizontal portion at the top of a characteristics line shown in FIG. 3 (i.e., state corresponding to a maximum flow rate). In such a case, therefore, the tilting angles θ1, θ2 of the swash plates 8A, 9A of the first and second hydraulic pumps 8, 9 are each given by a maximum tilting angle that is uniquely determined from the structural point of view.

After the end of above step 640, by using the input amount signals Xb, Xa, Xbu, Xtl, Xtr and Xs, respective spool opening areas Ab, Aa, Abu, Atl, Atr and As of the control valves 18 to 23 are calculated (or indirectly detected) in step 650 in accordance with the correlations between input amounts X and spool opening areas A of the control valves 18 to 23, which are stored and held in the recovery control section 40*c* beforehand (the correlations may be stored in any other suitable functioning unit of the controller 40 or may be inputted each time the operation is started).

Figure 9A:
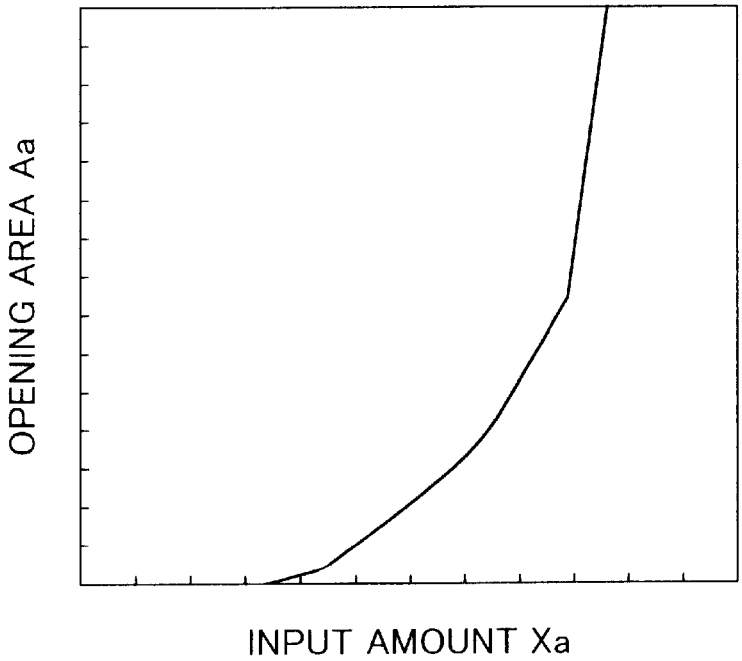
FIGS. 9A and 9B are each a graph representing one example of the correlation between a input amount of a control valve and a spool opening area.
Figure 9B:
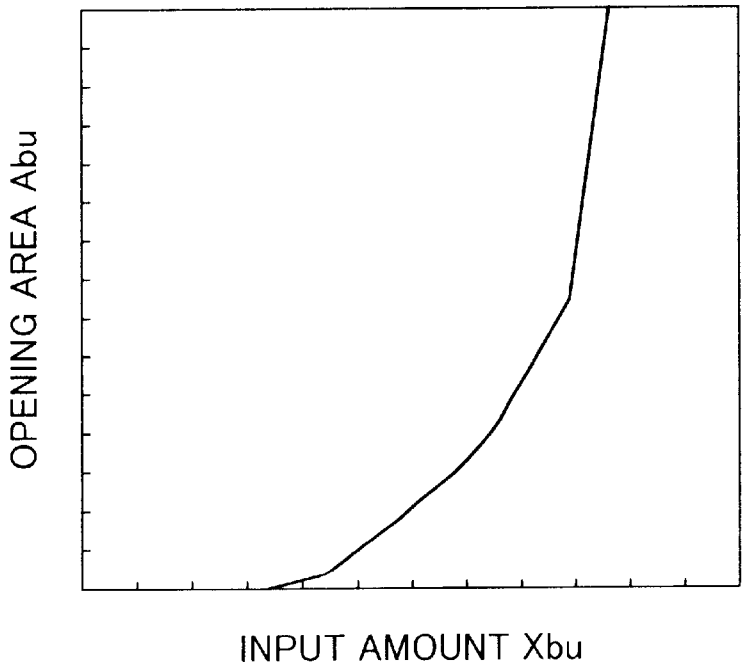

FIGS. 9A and 9B are graphs representing, as one example of those correlations used in step 650, the correlations between the input amounts Xa, Xbu (corresponding to spool strokes) of the arm and bucket control valves 19, 22 and the spool opening areas Aa, Abu.

Since this embodiment is, as described above, primarily adapted for control in the arm-crowding and bucket-crowding combined operation frequently performed in excavation, the following description is made in connection with that case. The spool opening areas Aa, Abu of the arm control valve 19 and the bucket control valve 22 are determined from the characteristics shown in FIGS. 9A and 9B. In the arm-crowding and bucket-crowding combined operation, any other components than the arm 1*b* and the bucket 1*c* are not operated and the hydraulic fluid delivered from the first and second hydraulic pumps 8, 9 is all supplied to the arm hydraulic cylinder 12 and the bucket hydraulic cylinder 13. To obtain a distribution ratio of the hydraulic fluid, an opening area ratio Aa:Abu is calculated from the opening areas Aa, Abu of the arm and bucket control valves 19, 22.

Then, the control flow proceeds to step 660 where a modification coefficient k for a flow rate distribution ratio (=inlet flow rate) Aa:kAbu on the basis of the opening area ratio Aa:Abu is determined. A value of the distribution ratio is thereby determined.

In the arm-crowding and bucket-crowding combined operation of the hydraulic excavator described above with reference to FIG. 1, the load pressures of the arm hydraulic cylinder 12 and the bucket hydraulic cylinder 13 are usually almost the same. In that combined operation, since the arm control valve 19 and the bucket control valve 22 are connected in parallel as described above, the pressures upstream of the arm control valve 19 and the bucket control valve 22 are also almost the same. Accordingly, the differential pressures across the arm control valve 19 and the bucket control valve 22 are almost the same. In that case, therefore, the ratio between the flow rates through the arm control valve 19 and the bucket control valve 22 (=distribution ratio between the flow rates of the hydraulic fluid supplied from the hydraulic pumps 8, 9 to the arm hydraulic cylinder 12 and the bucket hydraulic cylinder 13) is substantially uniquely determined in accordance with the opening area ratio Aa:Abu. It is hence possible to set $k \approx 1$.

When more precise control is desired, a value of k may be obtained by determining experimental values of k beforehand while changing various conditions such as a posture of the front mechanism 1, detecting the posture of the front mechanism 1 based on the input amount signals Xb, Xa. Xbu, Xtl, Xtr and Xs received in step 630 or other signals from stroke sensors, etc. provided separately, and selecting an appropriate value of k depending on the detected posture. Assuming the arm-crowding and bucket-crowding combined operation, in particular, it is preferable to set $k<1$ because the load pressure of the bucket hydraulic cylinder 13 is greatly increased and the flow rate of the hydraulic fluid supplied to the bucket hydraulic cylinder 13 is reduced even with the opening areas Aa, Abu being the same.

After the end of above step 660, the control flow proceeds to step 670 where the actuator flow rate (arm flow rate) Qa of the hydraulic fluid supplied to the bottom-side hydraulic chamber 12*a* of the arm hydraulic cylinder 12 via the bottom-side lines 101*a*, 101*b* is determined (or indirectly detected) from the total delivery rate Q1+Q2 of the first and second hydraulic pumps 8, 9 calculated in above step 640 and the distribution ratio Aa:kAbu using the value of k determined in above step 660.

After the end of step 670, the control flow proceeds to step 700.

Figure 10:
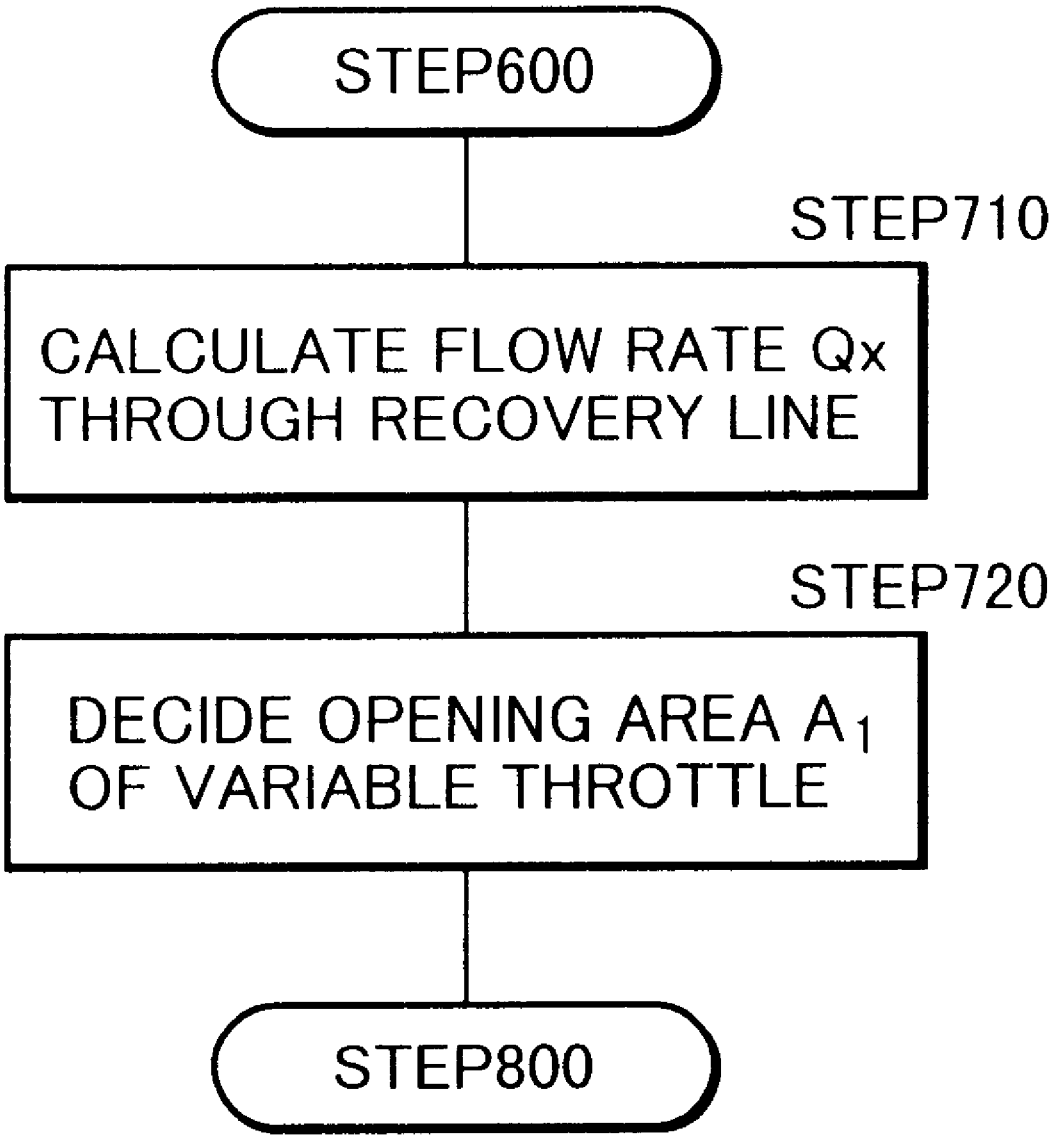
FIG. 10 is a flowchart representing control steps executed by the recovery control section of the controller incorporated in the hydraulic recovery system according to one embodiment of the present invention.

Returning to FIG. 7, in step 700, an opening area A1 of the throttle valve of the recovery valve 103 is decided based on the above arm flow rate Qa. FIG. 10 is a flowchart showing details of step 700.

In FIG. 10, first, a flow rate (hereinafter referred to also as a "recovery flow rate") Qx of the hydraulic fluid passing through the recovery line 103Aa via the throttle valve of the recovery valve 103 is calculated in step 710. Then, in step 720, the opening area A1 of the throttle valve in the recovery line 103Aa is decided using the calculated recovery flow rate Qx. Practically, the processing of step 720 is executed as follows.

Figure 11:
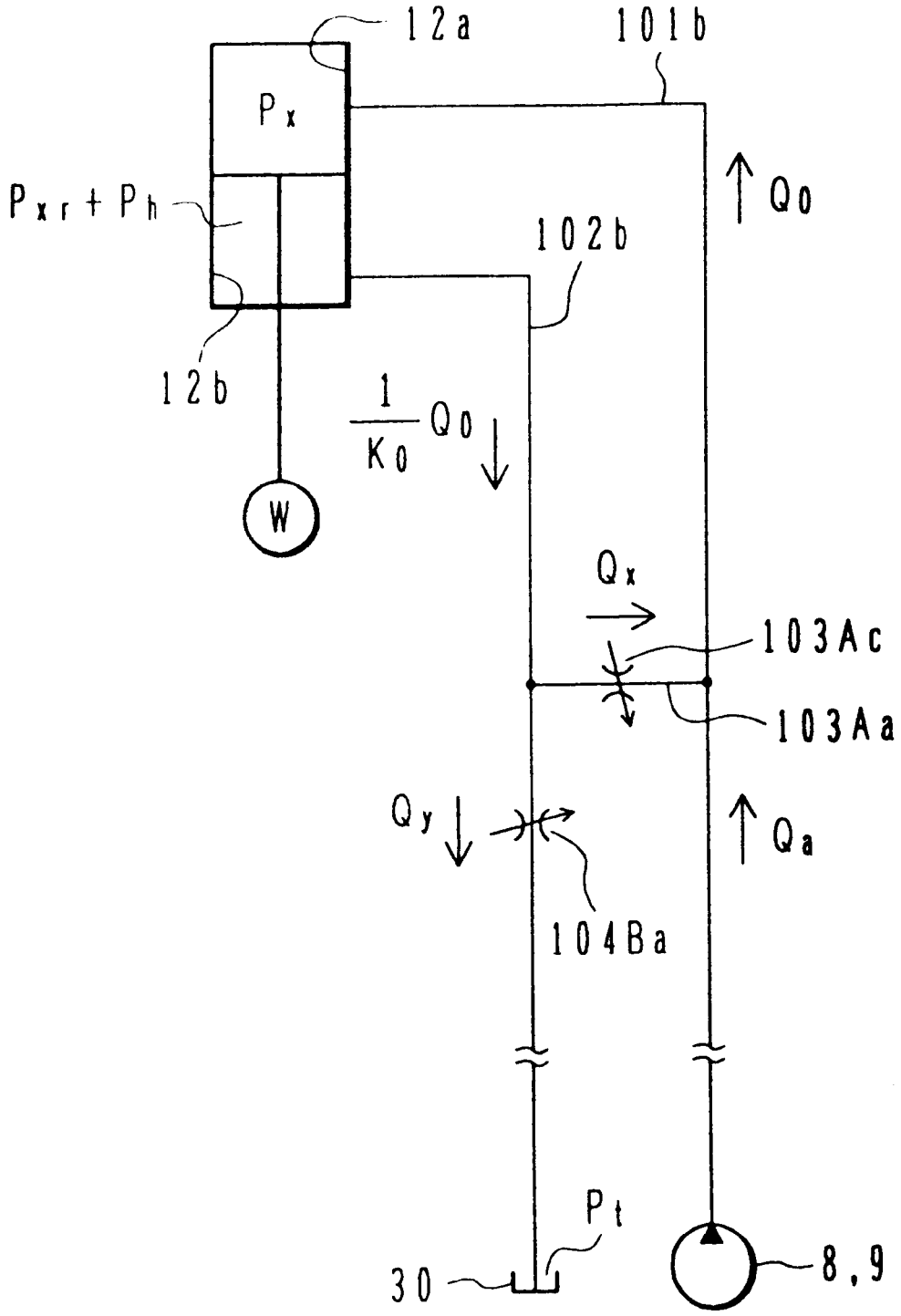
FIG. 11 is a schematic view referred to in considering hydraulic flow rates related to an arm hydraulic cylinder.

FIG. 11 is a schematic view referred to in considering hydraulic flow rates related to the arm hydraulic cylinder 12. Referring to FIG. 11, a flow rate (hereinafter referred to also as a "bottom-side introduced flow rate") $Q_0$ introduced to the bottom-side hydraulic chamber 12*a* of the arm hydraulic cylinder 12 is stored and held in the recovery control section 40*c* beforehand depending on at what high speed the arm crowding operation should be performed ($Q_0$ may be stored in any other suitable functioning unit of the controller 40 or may be inputted each time the operation is started). The bottom-side introduced flow rate $Q_0$ is equal to the total of the arm flow rate Qa supplied from the first and second hydraulic pumps 8, 9 and the recovery flow rate Qx. From $Q_0$ and the arm flow rate Qa decided in step 600 therefore, the recovery flow rate Qx can be obtained by:

$$Qx=Q_0-Qa \quad \text{(Eq. 1)}$$

On the other hand, an internal pressure (hereinafter referred to also as a "bottom-side pressure") Pxb (≧0) to be held in the bottom-side hydraulic chamber 12*a* of the arm hydraulic cylinder 12, which satisfies the condition that no cavitation occurs in the bottom-side hydraulic chamber 12*a* due to a deficiency of the hydraulic fluid, is stored and held in the recovery control section 40*c* beforehand (Pxb may be stored in any other suitable functioning unit of the controller 40 or may be inputted each time the operation is started).

Herein, since the primary object of this embodiment is to prevent the occurrence of cavitation, the above condition can be through as a condition that a holding pressure Ph in the rod-side hydraulic chamber 12*b* of the arm hydraulic cylinder 12 (pressure required for bearing its own dead weight, e.g., 30 km/cm$^2$, Ph may be stored in the recovery control section 40*c* or any other suitable functioning unit beforehand, or may be inputted each time the operation is started) becomes constant in a state where a load W is applied downward (in the arm-crowding direction) as shown in FIG. 11. (From that point of view, this embodiment can be regarded as aiming at recovery flow rate control for realizing the constant holding pressure or recovery flow rate control for realizing a constant differential pressure between the bottom side and the rod side of the arm hydraulic cylinder 12). Although a value of the holding pressure Ph changes depending on the posture of the front mechanism 1, there is no problem from the standpoint of control by storing a maximum value of the holding pressure Ph (e.g., a value in the arm crowding operation during a range from a state of the arm 1*b* being substantially horizontal in which cavitation is most likely to occur).

Further, a pressure bearing area ratio (=volume ratio) k0 between the bottom-side hydraulic chamber 12*a* and the rod-side hydraulic chamber 12*b* of the arm hydraulic cylinder 12 is uniquely determined depending on the structural configuration of the arm hydraulic cylinder 12 and is stored and held in the recovery control section 40*c* beforehand (k0 may be stored in any other suitable functioning unit of the controller 40 or may be inputted each time the operation is started). Therefore, a balance pressure Pxr to be generated in the rod-side hydraulic chamber 12*b* for a balance with the bottom-side pressure Pxb is given by Pxr=k0*Pxb. As a result, the internal pressure (hereinafter referred to also as the "rod-side pressure") to be held in the rod-side hydraulic chamber 12*b* is expressed by:

$$Pxr+Ph=k0*Pxb+Ph$$

Then, a differential pressure ΔP1 across the recovery line 103Aa of the recovery valve 103 can be expressed by:

$$\Delta P1=Pxr+Ph-Pxb=(k0*Pxb+Ph)-Pxb=(k0-1)Pxb+Ph \quad \text{(Eq. 2)}$$

Herein, since the flow rate Qx of the hydraulic fluid passing through the recovery line 103As is obtained by above Eq. 1, the opening area A1 of a variable throttle 103Ac (see FIG. 11) in the recovery line 103Aa can be decided from Qx and the differential pressure ΔP1 obtained by above Eq. 2.

After the end of step 700, the control flow proceeds to step 800.

Figure 12:
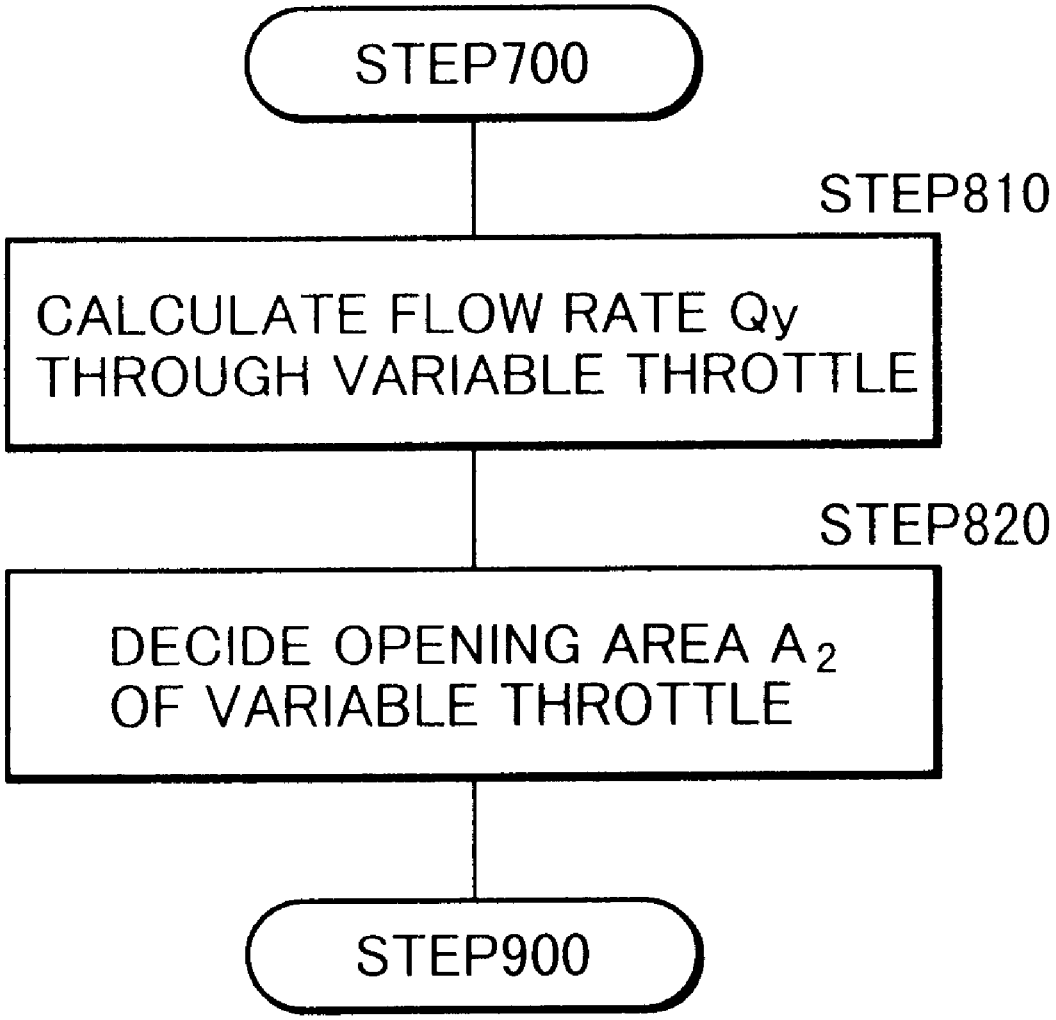
FIG. 12 is a flowchart representing control steps executed by the recovery control section of the controller incorporated in the hydraulic recovery system according to one embodiment of the present invention.

Returning to FIG. 7, in step 800, an opening area A2 of the variable throttle 104Ba of the throttle valve 104 is decided based on the above recovery flow rate Qx. FIG. 12 is a flowchart showing details of step 800.

In FIG. 12, first, a flow rate (hereinafter referred to also as a "throttle flow rate") Qy of the hydraulic fluid passing through the variable throttle 104Ba of the throttle valve 104 is calculated in step 810. Then, in step 820, the opening area A2 of the variable throttle 104Ba is decided using the calculated throttle flow rate Qy. Practically, the processing of step 820 is executed as follows.

Referring to FIG. 11, a flow rate (hereinafter referred to also as a "rod-side let-out flow rate") $Q_0'$ let out of the rod-side hydraulic chamber 12*b* of the arm hydraulic cylinder 12 is expressed as given below, using the pressure bearing area ratio k0 between the bottom-side hydraulic chamber 12*a* and the rod-side hydraulic chamber 12*b* of the arm hydraulic cylinder 12:

$$Q_0'=(1/k0)Q_0$$

Since the throttle flow rate Qy is equal to the difference between $Q_0'$ and the recovery flow rate Qx expressed by Eq. 1, it is obtained by:

$$Qy=Q_0'-Qx=(1/k0)Q_0-(Q_0-Qa)=\{(1-k0)/k0\}Q_0+Qa \quad \text{(Eq. 3)}$$

On the other hand, the pressure upstream of the throttle valve 104 is equal to the rod-side pressure Py+Ph (=k0*Px+Ph), and the pressure downstream of the throttle valve 104 is equal to a reservoir pressure Pt because it is connected to the hydraulic reservoir 30.

Accordingly, a differential pressure ΔP2 across the variable throttle 104Ba of the throttle valve 104 can be expressed by:

$$\Delta P2=Py+Ph-Pt=k0*Px+Ph-Pt \quad \text{(Eq. 4)}$$

Then, since the flow rate Qy of the hydraulic fluid passing through the variable throttle 104Ba is obtained by above Eq. 3, the opening area A2 of the variable throttle 104Ba of the throttle valve 104 can be decided from Qy and the differential pressure ΔP2 obtained by above Eq. 4.

After the end of step 820, the control flow proceeds to step 900.

Returning to FIG. 7, in step 900, based on the recovery valve opening area A1 and the throttle valve opening area A2 decided in above steps 700 and 800, the recovery control section 40*c* produces the drive signals S01, S02 applied to the recovery valve 103 and the throttle valve 104 for setting those valves to desired opening to provide the corresponding opening areas A1, A2, and then outputs the produced drive signals S01, S02 to the solenoid proportional valve 103*a*A of the recovery valve 103 and the solenoid proportional valve 104*a*A of the throttle valve 104, thereby ending the control flow.

In the above description, the arm hydraulic cylinder 12 constitutes a particular hydraulic cylinder set forth in claims. The arm hydraulic cylinder 12, the boom hydraulic cylinder 11, the bucket hydraulic cylinder 13, the left track hydraulic motors 14, the right track hydraulic motor 15, and the swing hydraulic motor 16 constitute a plurality of actuators. Also, the control valves 18, 19, 20, 21, 22 and 23 constitute a plurality of control valves disposed between a hydraulic pump and the plurality of actuators, respectively, for controlling flows of a hydraulic fluid supplied to the corresponding actuators. Among those control valves, the arm control valve 19 constitutes a particular control valve for controlling the flow of the hydraulic fluid supplied to the particular hydraulic cylinder.

The bottom-side lines 101*a*, 101*b* constitute a first line for supplying the hydraulic fluid to the bottom side of at least one particular hydraulic cylinder, and the rod-side lines 102*a*, 102*b* constitute a second line for draining the hydraulic fluid from the rod side of the particular hydraulic cylinder. In this connection, the variable throttle 103Ac in the recovery line 103Aa constitutes a second variable throttle, and the recovery valve 103 constitutes recovery valve means for supplying at least a part of the hydraulic fluid from the second line to the first line through the second variable throttle. Further, the variable throttle 104Ba constitutes a first variable throttle, and the throttle valve 104 constitutes throttle valve means for returning the remaining part of the hydraulic fluid, which is not recovered, from the second line to the hydraulic reservoir through the first variable throttle.

Step 610 in the flowchart of FIG. 8, executed in the recovery control section 40*c* of the controller 40, and the revolution speed sensor 105 constitute revolution speed detecting means for detecting a revolution speed of a prime mover for driving the hydraulic pump. Step 630 and the pressure sensors 137 to 142 constitute a plurality of input amount detecting means for detecting respective input amounts of a plurality of operating means for operating the plurality of actuators. In cooperation with those detecting means, steps 620 and 640 constitute delivery rate detecting means for detecting a delivery rate of the hydraulic pump. Further, step 650 in the flowchart of FIG. 8 constitutes opening area ratio detecting means for detecting an opening area ratio between the plurality of control valves. Step 660 constitutes modifying means for modifying the detected opening area ratio depending on operating states of the plurality of actuators. Also, those two steps 650, 660 constitute distribution ratio deciding means for deciding a distribution ratio of the detected delivery rate to the respective actuators. In cooperation with the above-mentioned arrangement, step 670 constitutes actuator flow rate detecting means for detecting the actuator flow rate.

Step 710 in the flowchart of FIG. 10 and step 810 in the flowchart of FIG. 12, which are executed in the recovery control section 40*c* of the controller 40, constitute first and second throttle flow rate deciding means for deciding respective throttle flow rates through the second variable throttle and the first variable throttle depending on the detected actuator flow rate. Step 720 in the flowchart of FIG. 10 and step 820 in the flowchart of FIG. 12 constitute first and second opening area deciding means for deciding respective opening areas of the first variable throttle and the second variable throttle depending on the decided throttle flow rates. All of the above-mentioned components constitute opening area varying means for varying the respective opening areas of the first variable throttle and the second variable throttle depending on the detected actuator flow rate.

Furthermore, the bottom-side introduced flow rate $Q_0$ described above with reference to FIG. 11 corresponds to an inlet setting flow rate at which the hydraulic fluid is introduced to the bottom side of the particular hydraulic cylinder, and the bottom side pressure Pxb corresponds to a bottom setting pressure that is set to prevent the occurrence of cavitation in a bottom-side hydraulic chamber of the particular hydraulic cylinder.

Additionally, all means and steps constituting the actuator flow rate detecting means and the opening area varying means constitute control means for controlling the respective opening areas of the first variable throttle and the second variable throttle depending on the actuator flow rate supplied from the hydraulic pump to the particular hydraulic cylinder.

The operation and advantages of the thus-constructed hydraulic recovery system of this embodiment will be described below. This embodiment is intended, as described above, to perform the arm crowding operation at a higher speed by recovering a part of the hydraulic fluid drained from the arm hydraulic cylinder 12.

(1) Arm-crowding Sole Operation

In usual excavation work, for instance, a series of following operations are performed as a typical example. The arm-crowding and bucket-crowding combined operation is performed to dig in the ground and scoop dug-up earth and sand by the bucket 1*c*. Then, the scooped earth and sand are loaded on a dump track or the like by performing the combined operation of boom raising, arm dumping and bucket dumping. Thereafter, the arm-crowding sole operation is performed for rendering the bucket 1*c* to reach the ground surface again for excavation. In the arm-crowding sole operation, since the bucket 1*c* is empty, it is preferable from the standpoint of work efficiency to crowd the arm at a speed as high as possible during a stroke until the bucket 1*c* reaches the ground surface.

In this embodiment, when the operator operates the control lever 63*a* of the arm control lever device 63 in a direction corresponding to the arm crowding in such a situation, a pilot pressure is produced in the pilot line 69*a* and the arm control valve 19 is shifted to the shift position 19A. Thereby, the hydraulic fluid from the first hydraulic pump 8 is introduced to the arm meter-in line 74 via the delivery line 26 and the center bypass line 49, and at the same time the hydraulic fluid from the second hydraulic pump 9 is introduced to the arm meter-in line 74 in joined fashion via the delivery line 27, the center bypass line 50, the boom-lowering meter-in line 75 and the arm communicating line 73. Accordingly, a total flow rate of the hydraulic fluids from the first and second hydraulic pumps 8, 9 is supplied to the bottom-side hydraulic chamber 12*a* of the arm hydraulic cylinder 12 from the arm meter-in line 74 via the bottom-side lines 101*a*, 101*b*.

Because the pilot pressure Xac produced in the pilot line 69*a* is detected by the pressure sensor 143, the determination made in step 200 in the flowchart of FIG. 7, executed in the recovery control section 40*c* of the controller 40, is satisfied. Further, because the bucket 1*c* is empty, the load pressure Pab in the bottom-side line 101*a* detected by the pressure sensor 144 is small and the determination made in step 500 is satisfied.

In that condition, the delivery rates Q1, Q2 of the hydraulic pumps 8, 9 are increased under the negative control in match with the demanded flow rate (spool stroke amount) of the arm control valve 19. In step 600, therefore, the actuator flow rate (=arm flow rate) Qa is calculated as a total Q1+Q2 of both the delivery rates.

Then, in steps 700 and 800, the opening area A1 of the recovery valve 103 and the opening area A2 of the throttle valve 104 are controlled under the condition of the arm flow rate Qa to obtain the bottom-side introduced flow rate $Q_0$, at which the arm can be operated at a desired high speed, while ensuring that cavitation will not occur in the bottom-side hydraulic chamber 12*a* of the arm hydraulic cylinder 12 due to a deficiency of the hydraulic fluid (i.e., that the bottom-side pressure Pxb is always held in the bottom-side hydraulic chamber 12*a*).

For the sake of easier understanding, one practical example of that control will be described below using numerical ratios with reference to FIG. 11. Assuming that the arm flow rate Qa is represented by a reference value 1.0 and the bottom-side introduced flow rate $Q_0$ is required to be, e.g., 1.2 for the operation at a higher speed, the difference 0.2 between $Q_0$ and Qa must be recovered as the recovery flow rate Qx. At this time, assuming that the pressure bearing area ratio k0 between the bottom side and the rod side is given by k0=2:1, the rod-side let-out flow rate $Q_0'$ is a half of $Q_0$, i.e., 0.6. Thus, the opening area A1 of the recovery valve 103 and the opening area A2 of the throttle valve 104 are controlled such that a part 0.2 of 0.6 is recovered as the recovery flow rate Qx and the remaining 0.4 is drained as the throttle flow rate Qy.

As a result of the above-described control, the drained hydraulic fluid is recovered at the desired recovery flow rate Qx to ensure the desired bottom-side introduced flow rate $Q_0$, and the arm crowding operation can be performed at a higher speed for an improvement of the work efficiency.

(2) Arm-crowding and Bucket-crowding Combined Operation

In the course of the arm-crowding sole operation, the bucket 1*c* is also often crowded (i.e., a shift to the arm-crowding and bucket-crowding combined operation) for smooth transition to the subsequent excavation work (see FIG. 1). In such a case, when the operator further operates the control lever 64*a* of the bucket control lever device 64 in a direction corresponding to the bucket crowding, a pilot pressure is produced in the pilot line 70*a* and the bucket control valve 22 is shifted to the shift position 22A on the right side in FIGS. 2A and 2B. Thereby, as described above, the arm control valve 19 and the bucket control valve 22 are connected in parallel with respect to the second hydraulic pump 9. Hence, a substantial part (e.g., about ½) of the hydraulic fluid from the second hydraulic pump 9, which has been all supplied to the arm hydraulic cylinder 12 so far via the arm communicating line 73, is now introduced to the bottom-side hydraulic chamber 13*a* of the bucket hydraulic cylinder 13 via the bucket meter-in line 72. As a result, the flow rate of the hydraulic fluid (=arm flow rate Qa) supplied to the bottom-side hydraulic chamber 12*a* of the arm hydraulic cylinder 12 from the arm meter-in line 74 via the bottom-side lines 101*a,* 101*b* is greatly reduced. In this condition, the hydraulic fluid cannot be supplied to the bottom-side hydraulic chamber 12*a* of the arm hydraulic cylinder 12 at a sufficient flow rate even with an addition of the recovery flow rate Qx, and it is difficult to satisfactorily follow the high-speed arm crowding operation that has been performed so far. This leads to a possibility that such a deficiency of the supply flow rate may cause the occurrence of bubbles (cavitation) in the bottom side hydraulic chamber 12*a* of the arm hydraulic cylinder 12 and the hydraulic circuits (including, e.g., the bottom-side lines 101*a,* 101*b*) connected to it, thus resulting in deterioration of operability and durability.

Such a situation is coped with by this embodiment as follows. A reduction of the arm flow rate Qa is calculated (detected) in step 600. Then, in steps 700 and 800, the opening area A1 of the recovery valve 103 and the opening area A2 of the throttle valve 104 are controlled (for example, the opening area A1 is increased and the opening area A2 is reduced) so that the reduction of the arm flow rate Qa is compensated with an increase of the recovery flow rate Qx and the bottom-side introduced flow rate $Q_0$ remains the same as so far.

As with the above case, one practical example of that control will be described below using numerical ratios with reference to FIG. 11. Assuming that the arm flow rate Qa is reduced from 1.0 in the arm-crowding sole operation to 0.7 upon a shift to the arm-crowding and bucket-crowding combined operation, the recovery control section 40*c* of the controller 40 makes control to increase the recovery flow rate Qx to 0.5 by increasing the opening area A1 of the recovery valve 103 and reducing the opening area A2 of the throttle valve 104. This control enables the bottom-side introduced flow rate $Q_0$, which is the sum of the arm flow rate Qa and the recovery flow rate Qx, to be continuously maintained at 1.2 (that is, since the rod-side let-out flow rate $Q_0'$ remains at 0.6, a part 0.5 of 0.6 recovered as the recovery flow rate Qx and the remaining part 0.1 is drained as the throttle flow rate Qy). As a result, the high-speed arm crowding operation can be continued in a similar way as so far without causing cavitation in the bottom side hydraulic chamber 12*a* of the arm hydraulic cylinder 12 and the hydraulic circuits connected to it. An improvement is hence achieved in operability and durability of the bottom side hydraulic chamber 12*a* of the arm hydraulic cylinder 12 and the hydraulic circuits connected to it.

With this embodiment, as described above, a reduction of the arm flow rate Qa caused upon a shift to the combined operation is compensated by increasing the recovery flow rate Qx so that the hydraulic fluid can be continuously supplied at a sufficient flow rate $Q_0$ to the bottom side hydraulic chamber 12*a* of the arm hydraulic cylinder 12. It is therefore possible to prevent cavitation from occurring in the bottom side hydraulic chamber 12*a* of the arm hydraulic cylinder 12, the bottom-side lines 101*a,* 101*b,* etc. due to a deficiency of the supply flow rate, and to improve operability and durability.

While the above description is made, by way of example, in connection with a reduction of the arm flow rate Qa caused upon a shift to the combined operation, the application is not limited to such a case. This embodiment is also adaptable for, e.g., the case where the revolution speed of the engine 17 for driving the hydraulic pumps 8, 9 are lowered due to, e.g., an increase in load of any actuator, changeover of the setting revolution speed of the engine 17, or changeover of the operating modes which are known in the hydraulic excavator of the above-mentioned type, and hence the arm flow rate Qa is reduced. Thus, in any situation where the arm flow rate Qa is reduced, the hydraulic recovery system of this embodiment immediately operates in response to the reduction of the arm flow rate Qa and effectively functions in the same manner as described above. As a result, similar advantages to those described above can be obtained.

Although the above-cited JP,A 3-117704 does not clearly disclose, it is usual in conventional hydraulic recovery system that a recovery valve unit including recovery valve means is disposed in many cases within or near a control valve (monoblock control valve) in which spool for operating respective actuators are incorporated in one body (intensive recovery valve unit). Such an intensive recovery valve unit has a large line pressure loss because of a long line distance between itself and the actuator, and hence has invited a difficulty in recovering a part of the drained hydraulic fluid.

More specifically, it is a general rule that, when recovering a part of the hydraulic fluid drained from a hydraulic cylinder, the recovery flow rate can be more easily increased as the recovery line pressure on the rod side of the hydraulic cylinder is higher and the recovery line pressure on the bottom side of the hydraulic cylinder is lower. In the hydraulic recovery system employing the above-mentioned intensive recovery valve unit, since the valve unit is positioned near the control valve, a recovery line is disposed remotely from the hydraulic cylinder and a pressure loss caused in an intermediate line becomes relatively large. Thus, the recovery line pressure on the bottom side is increased because it is positioned closer to a hydraulic pump, and the recovery line pressure on the rod side is reduced by an amount corresponding to the above-mentioned pressure loss. It is hence difficult to obtain a large recovery flow rate.

By contrast, in this embodiment, the recovery valve unit 100 including the recovery valve 103 is disposed on the boom 1*a* as shown in FIGS. 1 and 6 (more exactly speaking, at a position closer to the arm hydraulic cylinder 12 than the middle between the control valve unit 7 and the arm hydraulic cylinder 12). With that arrangement, the pressure loss in the recovery line can be reduced so that the pressure at a port of the recovery valve 103 communicating with the rod side hydraulic chamber 12*b* of the arm hydraulic cylinder 12 can be maintained relatively high and the pressure at a port of the recovery valve 103 communicating with the bottom side hydraulic chamber 12*a* thereof can be maintained relatively low. This is effective in more easily obtaining a larger recovery flow rate Qx. As seen from the above description, insofar as the above effect is to be obtained, both the recovery valve 103 and the throttle valve 104 of the recovery valve unit 100 are not always required to locate on the side nearer to the arm hydraulic cylinder 12, and the recovery valve 103 and the throttle valve 104 may be of a separated structure such that only the recovery valve 103 is disposed on the side nearer to the arm hydraulic cylinder 12.

While in the above embodiment the arm flow rate Qa is computed through steps 610 to 670 in FIG. 8, the computing method is not limited to the above-described one, and the arm flow rate Qa may be computed using any other suitable method. As an alternative, the arm flow rate Qa may be directly or indirectly detected by providing a flow rate detecting means (such as a known flowmeter) in the bottom-side line 101*a*. Such a modification can also provide similar advantages to those described above.

Also, while the above embodiment has been described in connected with the arm-crowding and bucket-crowding combined operation as one example of the combined operation in which a deficiency of the flow rate of the hydraulic fluid supplied to the arm hydraulic cylinder 12 may occur, such a situation is not limited to the described one. In other words, the present invention can also be applied to the combined operation of arm crowding, bucket crowding and boom lowering or the combined operation of the so-called loader type hydraulic excavator, and can provide similar advantages to those described above.

Further, while in the above embodiment the present invention is applied to the arm hydraulic cylinder 12 for improving operability and durability thereof in the high-speed operation, the present invention is not limited to such an application. As a matter of course, the present invention is also applicable to any of the other hydraulic cylinders 11, 13. Anyway, similar advantages to those described above can be provided.

While the above description has been made, by way of example, in connection with the front mechanism 1 of the hydraulic excavator, which comprises the boom 1*a*, the arm 1*b* and the bucket 1*c*, the front mechanism 1 is not limited to such a construction. For example, another attachment, such as a grapple, may be attached in place of the bucket 1*c*. It is essential that the front mechanism 1 is of a multi-articulated structure as a whole. Such a modification can also provide similar advantages to those described above.

It is needless to say that the scope of the technical concept of the present invention contains modifications of the above-described arrangements in which at least a part of the functions executed under control of the controller 40 (particularly the recovery control section 40*c*) using electrical signals is replaced by mechanical operation such as realized by a hydraulic circuit, for example. The basic technical concept of the present invention resides in that the opening areas of both the second throttle valve of the recovery valve means and the first throttle valve of the throttle valve means are controlled depending on the actuator flow rate supplied from the hydraulic pump to the particular hydraulic cylinder. As a result, cavitation can be prevented from occurring in the particular hydraulic cylinder and its peripheral circuits even upon, e.g., a shift to the combined operation or a decrease in revolution speed of the prime mover. Hence, operability and durability can be improved.

According to the present invention, as described above, the second variable throttle is provided in the recovery valve means for supplying a part of the hydraulic fluid from the second line to the first line, and the first variable throttle is provided in the throttle valve means for returning the remaining part of the hydraulic fluid, which is not recovered, from the second line to the hydraulic reservoir. Further, the control means controls the opening areas of the first throttle valve and the second throttle valve depending on the actuator flow rate supplied from the hydraulic pump to the particular hydraulic cylinder. Therefore, even when the actuator flow rate is reduced upon, e.g., a shift to the combined operation or a decrease in revolution speed of the prime mover, such a reduction of the arm flow rate is compensated by increasing the recovery flow rate so that the hydraulic fluid can be continuously supplied at a sufficient flow rate to the bottom side of the arm hydraulic cylinder. It is hence possible to prevent cavitation from occurring in the bottom side hydraulic chamber of the particular hydraulic cylinder and its peripheral hydraulic circuits due to a deficiency of the supply flow rate, and to improve operability and durability.

What is claimed is:

1. A hydraulic recovery system for a construction machine, said hydraulic recovery system being provided in a hydraulic drive system for driving a plurality of actuators by a hydraulic fluid supplied from at least one hydraulic pump in the construction machine, said hydraulic recovery system comprising:

a first line for supplying the hydraulic fluid to the bottom side of at least one particular hydraulic cylinder among said plurality of actuators;

a second line for draining the hydraulic fluid from the rod side of said particular hydraulic cylinder;

recovery valve means for supplying at least a part of the hydraulic fluid from said second line to said first line;

a second variable throttle provided in said recovery valve means and supplying at least said part of the hydraulic fluid from said second line to said first line at a desired opening;

throttle valve means for returning the remaining part of the hydraulic fluid, which is not recovered, from said second line to a hydraulic reservoir;

a first variable throttle provided in said throttle valve means and returning the remaining part of the hydraulic fluid, which is not recovered, to said hydraulic reservoir at a desired opening; and control means for controlling respective opening areas of said first variable throttle and said second variable throttle depending on an actuator flow rate supplied from said hydraulic pump to said particular hydraulic cylinder.

2. A hydraulic recovery system for a construction machine according to claim 1, wherein said control means comprises actuator flow rate detecting means for detecting the actuator flow rate, and opening area varying means for varying the respective opening areas of said first variable throttle and said second variable throttle depending on the detected actuator flow rate.

3. A hydraulic recovery system for a construction machine according to claim 2, wherein said actuator flow rate detecting means comprises delivery rate detecting means for detecting a delivery rate of said hydraulic pump, and distribution ratio deciding means for deciding a distribution ratio of the detected delivery rate to respective actuators.

4. A hydraulic recovery system for a construction machine according to claim 3, wherein said delivery rate detecting means comprises revolution speed detecting means for detecting a revolution speed of a prime mover for driving said hydraulic pump.

5. A hydraulic recovery system for a construction machine according to claim 4, wherein said delivery rate detecting means comprises a plurality of input amount detecting means for detecting respective input amounts of a plurality of operating means for operating said plurality of actuators.

6. A hydraulic recovery system for a construction machine according to claim 3, wherein said distribution ratio deciding means comprises opening area ratio detecting means for detecting an opening area ratio between a plurality of control valves disposed between said hydraulic pump and said plurality of actuators, respectively, for controlling flows of the hydraulic fluid supplied to the corresponding actuators, and modifying means for modifying the detected opening area ratio depending on operating states of said plurality of actuators.

7. A hydraulic recovery system for a construction machine according to claim 2, wherein said opening area varying means comprises first and second throttle flow rate deciding means for deciding respective throttle flow rates through said second variable throttle and said first variable throttle depending on the detected actuator flow rate, and first and second opening area deciding means for deciding respective opening areas of said second variable throttle and said first variable throttle depending on the decided throttle flow rates.

8. A hydraulic recovery system for a construction machine according to claim 7, wherein said first throttle flow rate deciding means decides the throttle flow rate through said second variable throttle in accordance with both an inlet setting flow rate at which the hydraulic fluid is introduced to the bottom side of said particular hydraulic cylinder, and the detected actuator flow rate.

9. A hydraulic recovery system for a construction machine according to claim 8, wherein said second throttle flow rate deciding means decides the throttle flow rate through said first variable throttle in accordance with said inlet setting flow rate, a volume ratio between a bottom-side hydraulic chamber and a rod-side hydraulic chamber of said particular hydraulic cylinder, and the decided throttle flow rate through said second variable throttle.

10. A hydraulic recovery system for a construction machine according to claim 7, wherein said first opening area deciding means decides the opening area of said second variable throttle in accordance with the decided throttle flow rate through said second variable throttle, a bottom setting pressure set to prevent the occurrence of cavitation in a bottom-side hydraulic chamber of said particular hydraulic cylinder, a volume ratio between the bottom-side hydraulic chamber and a rod-side hydraulic chamber of said particular hydraulic cylinder, and a holding pressure to be maintained in said particular hydraulic cylinder.

11. A hydraulic recovery system for a construction machine according to claim 10, wherein said second opening area deciding means decides the opening area of said first variable throttle in accordance with the decided throttle flow rate through said first variable throttle, said bottom setting pressure, said volume ratio, said holding pressure, and a reservoir pressure in said hydraulic reservoir.

12. A construction machine comprising:

a lower travel structure;

an upper swing structure rotatably mounted on said lower travel structure;

a multi-articulated front mechanism rotatably coupled to said upper swing structure and including a boom, an arm and a bucket;

a plurality of actuators including a boom hydraulic cylinder, an arm hydraulic cylinder and a bucket hydraulic cylinder for driving said boom, said arm and said bucket, respectively;

a first line for supplying a hydraulic fluid to the bottom side of at least one particular hydraulic cylinder among said plurality of actuators;

a second line for draining the hydraulic fluid from the rod side of said particular hydraulic cylinder;

recovery valve means for supplying at least a part of the hydraulic fluid from said second line to said first line through a second variable throttle;

throttle valve means for returning the remaining part of the hydraulic fluid, which is not recovered, from said second line to a hydraulic reservoir through a first variable throttle; and control means for controlling respective opening areas of said first variable throttle and said second variable throttle depending on an actuator flow rate supplied from said hydraulic pump to said particular hydraulic cylinder.

13. A construction machine according to claim 12, wherein said control means comprises actuator flow rate detecting means for detecting the actuator flow rate, and opening area varying means for varying the respective opening areas of said first variable throttle and said second variable throttle depending on the detected actuator flow rate.

14. A construction machine according to claim 12, wherein said recovery valve means is disposed, with respect to a particular control valve for controlling a flow of the hydraulic fluid supplied to said particular hydraulic cylinder from said hydraulic pump and to said particular hydraulic cylinder, at a position nearer to at least said particular hydraulic cylinder.

15. A construction machine according to claim 14, wherein said recovery valve means is disposed on said particular hydraulic cylinder.

16. A construction machine according to claim 12, wherein said recovery valve means is disposed on said boom.

17. A construction machine according to claim 12, wherein said recovery valve means and said throttle valve means are constructed as an integral unit and are disposed on said boom.

18. A construction machine according to claim 13, wherein said recovery valve means is disposed, with respect to a particular control valve for controlling a flow of the hydraulic fluid supplied to said particular hydraulic cylinder from said hydraulic pump and to said particular hydraulic cylinder, at a position nearer to at least said particular hydraulic cylinder.

19. A construction machine according to claim 13, wherein said recovery valve means is disposed on said boom.

20. A construction machine according to claim 13, wherein said recovery valve means and said throttle valve means are constructed as an integral unit and are disposed on said boom.

* * * * *